US006850726B1

(12) United States Patent
Mizuno et al.

(10) Patent No.: US 6,850,726 B1
(45) Date of Patent: Feb. 1, 2005

(54) IMAGE FORMING APPARATUS AND IMAGING METHOD

(75) Inventors: Tsuneo Mizuno, Kawasaki (JP); Hiroki Ohta, Kawasaki (JP); Atsushi Tano, Yokohama (JP); Hiroki Ushiroda, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/611,810

(22) Filed: Jul. 2, 2003

Related U.S. Application Data

(63) Continuation of application No. PCT/JP01/00164, filed on Jan. 12, 2001.

(51) Int. Cl.[7] ..... G03G 15/01
(52) U.S. Cl. ..... 399/299; 399/302; 399/308
(58) Field of Search ..... 399/297, 299, 399/302, 306, 308, 309, 310, 312, 298, 300

(56) References Cited

U.S. PATENT DOCUMENTS 6,470,166 B2 * 10/2002 Mizoguchi et al. ..... 399/302

* cited by examiner

*Primary Examiner*—Hoan Tran
(74) *Attorney, Agent, or Firm*—Westerman, Hattori, Daniels & Adrian, LLP

(57) ABSTRACT

An image forming apparatus or method which uses plural image forming units to form visible images of different colors by making developers of different colors adhere to image holders such as photosensitive drums electrostatically. In this apparatus or method, intermediate transfer electrode members such as intermediate transfer rollers are opposite to the image holders of the image forming units with a belt transfer member between them and voltage is applied to transfer images electrostatically from the image forming units to the belt transfer member in sequence in a way that the transferred images on the belt overlap each other. Each of the intermediate transfer electrode members is located on the belt surface away from a point (transfer nip) at which a corresponding image holder contacts the belt.

11 Claims, 20 Drawing Sheets

METAL ROLLER

METAL BRUSH

METAL SHEET

METAL SHAFT

METAL BLOCK

METAL PLATE

METAL BLADE

IMAGE FORMING APPARATUS AND IMAGING METHOD

This application is a continuation of international application PCT/JP01/00164, filed Jan. 12, 2001.

BACKGROUND OF THE INVENTION

1. Field of the Invention

The present invention relates to an image forming apparatus for a printer or copier which forms a color image through an electrophotographic process and a method thereof, and more particularly to an image forming apparatus involving an intermediate transfer process in which toner images of different colors formed on plural photosensitive drums are transferred to an intermediate transfer belt in a way for transferred images to overlap each other and the resulting image is finally transferred onto paper, and a method thereof.

2. Description of the Related Art

Conventionally image forming apparatuses such as printers which use an electrophotographic process to form color images are roughly classified into two types: the four-pass type and the single-pass (tandem) type.

FIG. 1 shows the process of a conventional four-pass system. The four-pass system has a single photosensitive drum 100 and a developing unit 106 for forming four color images: yellow (Y), magenta (M), cyan (C) and black (K) images. The surface of the photosensitive drum 100 is evenly charged by a charger 102 located after a cleaning blade 101 and an electrostatic latent image is formed through laser scanning by an exposure unit 104. Then, yellow toner in the developing unit 106 develops the photosensitive material on the drum to make the latent image appear and the yellow toner image is transferred to an intermediate transfer belt 108 which is in contact with the photosensitive drum 100. This toner transfer is electrostatically made by a transfer roller 110 which applies transfer voltage. After this, the same procedure is repeated for magenta, cyan and black toners in the order of mention so that the four color toner images are laid one upon another on the transfer belt 108. Finally a transfer roller 111 transfers the four color developers (toners) at a time onto paper and the resulting image is fixed by a fixing device 112.

Therefore, the four-pass system just requires one set of the following components for the intermediate transfer process: the photosensitive drum 100, cleaning blade 101, charger 102, exposure unit 104 and transfer roller 110. In this sense, the system is advantageous in terms of cost. However, the intermediate transfer belt 108 must be rotated four turns to make a single color image, which means that the speed of color printing is one fourth the speed of monochrome printing.

FIG. 2 shows the process of a single-pass type (tandem type) system (Japanese Published Unexamined Patent Application No. Hei 11-249452, etc). In the single-pass type system, image forming units 112-1 through 112-4 for yellow (Y), magenta (M), cyan (C) and black (K) are aligned in a row. The image forming units 112-1 through 112-4 respectively have photosensitive drums 114-1 through 114-4 around each of which a cleaning blade, a charger, an LED exposure unit and a developing device are located, and the image forming units 112-1 through 112-4 respectively form images of different colors. The images of different colors formed on the photosensitive drums 114-1 through 114-4 are electrostatically transferred in sequence to an intermediate transfer belt 116 moving in contact with the photosensitive drums 114-1 to 114-4, in a way to overlap each other as transfer voltage from transfer rollers 118-1 to 118-4 is applied to the belt; and finally the finished image is fixed on paper by a fixing device 122.

When a transfer belt is used as an intermediate transfer means as in this case, generally the process of transferring (and overlapping) images from the photosensitive drums to the intermediate transfer belt is referred to as primary transfer while the process of transferring four color images at a time from the intermediate transfer belt to paper is referred to as secondary transfer. Generally speaking, the transfer rollers 118, which are used for primary transfer, and a paper transfer roller 120 which is used for secondary transfer are both conductive sponge rollers. The primary transfer rollers and the secondary transfer rollers are respectively located opposite to the photosensitive drums and to a backup roller, with the intermediate transfer belt between them.

In this single-pass type system, a color image is obtained through a single-pass, so the printing speed is faster than in the four-pass type system. However since the single-pass type system requires an image forming unit and a transfer roller for each color, it is more costly.

In addition, the intermediate transfer rollers must have prescribed electric resistance, sponge hardness and sponge surface precision. Further, the intermediate transfer components are not treated as consumable like image forming units and their replacement period is relatively long, which means they must be electrically and mechanically durable enough. One approach to reducing cost and enhancing reliability may be to use metal intermediate transfer rollers. However, if metal rollers should be in pressure contact with the photosensitive drums through the intermediate transfer belt, the transfer nip as the point of contact between the photosensitive drum and the transfer belt would become unstable, resulting in local transfer failures. For this reason, it has been almost impossible to use metal rollers.

Furthermore, in a system which uses an intermediate transfer belt and a paper conveyer belt, sponge leavings from sponge transfer rollers may adhere to the rear face of the belt or the belt drive roller surface and thus cause slippage between the belt and the drive roller, resulting in serious image defects such as color alignment errors and jitter.

Another problem in the intermediate transfer process of the single-pass type system is that the time of primary transfer voltage application may coincide with the time of secondary transfer voltage application and the power supply to apply secondary transfer voltage may be turned on during primary transfer. In some such cases, the secondary transfer voltage (current) interfered with the primary transfer process through the intermediate transfer belt as a resistor, leading to an image defect such as streaks.

In the single-pass type system, as illustrated in FIG. 2, the intermediate transfer rollers 118-1 to 118-4 and the photosensitive drums 114-1 to 114-4 constitute a primary transfer section while the paper transfer roller 120 and the backup roller, which face each other with the intermediate belt transfer 116 between them, constitute a secondary transfer section; and as illustrated in FIG. 3, the volume resistance in the direction of the thickness of the intermediate transfer belt 116 is used for transfer. However, the volume resistance of the intermediate transfer belt 116 and the transfer voltage largely depend on each other as indicated in a result of measurement in FIG. 4 so transfer is apt to be unstable. Especially, when the transfer belt has considerably deteriorated over time, transfer image blurring often occurs. As the transfer voltage to be applied to the transfer rollers increases, the resistance of the transfer belt decreases and so there occurs much current leakage from the belt area other than its transfer area corresponding to the paper width, causing a problem such as loss of current or a failure to transfer an image onto paper with a small width.

SUMMARY OF THE INVENTION

The present invention has been made in view of the above circumstances and provides an image forming apparatus which uses plural intermediate transfer electrode members during an intermediate transfer process to improve durability and reliability and reduce cost, and a method thereof.

The invention also provides an image forming apparatus which prevents interference between the primary transfer voltage and the secondary transfer voltage during an intermediate transfer process and a method thereof.

According to an aspect of the present invention, the image forming apparatus has: plural image forming units which form visible images of different colors by making developers of different colors adhere to image holders such as photosensitive drums electrostatically; a belt transfer member (intermediate transfer belt) which lies in contact with image holders for the different colors to transfer the developers adhering to the image holders of the image forming units thereto and make the transferred images overlap each other; and intermediate transfer electrode members such as intermediate transfer rollers (primary transfer rollers), located opposite to the image holders of the image forming units with the belt transfer member between the electrode members and the carriers, to which transfer voltage is applied to transfer images electrostatically from the image forming units to the belt transfer member in sequence and make the transferred images overlap each other. According to the present invention, this image forming apparatus is characterized in that each of the intermediate transfer electrode members is located on a belt surface away from a point (transfer nip) at which a corresponding image holder contacts the belt.

Since the transfer rollers as intermediate transfer electrode members are located on the belt surface away from the belt contact points (transfer nips) of the photosensitive drums as image holders, low-cost rollers like metal rollers may be used instead of conventional costly conductive sponge rollers. For example, only the metal shaft of a conventional sponge roller may be used as an intermediate transfer roller. This reduces the intermediate transfer roller cost by 50% or more and eliminates one of the factors contributing to the high cost of the single-pass type system. In addition, this system does not need a sponge roller, there is no need to take into consideration change in the resistance and outer diameter of the sponge, and thermal change in the resistance and hardness of the sponge, so durability, stability, and reliability can be improved. Further, slippage of the moving belt which may be caused by sponge leavings is less likely to occur, so the problem of image quality deterioration due to color misalignment, jitter or the like is resolved.

Furthermore, the volume resistance of the transfer belt in its thickness direction is not employed; instead, the surface resistance of the intermediate transfer belt is employed because the intermediate transfer electrode members are located on the belt surface away from the belt contact points of the photosensitive drums. This surface resistance is stable even when the applied transfer voltage varies. Since an electric field for transfer is generated by the stable surface resistance, stability in transfer over a long time is assured.

According to another aspect of the invention, the plural intermediate transfer electrode members are located on the belt transfer member, for example, downstream in the belt advance direction from the points at which the image holders contact the belt. This makes it possible to assure, for example, a high transfer efficiency of 90% or more even when high primary transfer voltage is applied; thus the voltage margin on the high voltage side can be increased.

According to another aspect of the invention, preferably the most upstream intermediate transfer electrode member should be located upstream from the point at which the most upstream image holder contacts the belt, and the most downstream intermediate transfer electrode member should be located downstream from the point at which the most downstream image holder contacts the belt. In this arrangement, the transfer nips as the belt contact points of the plural photosensitive drums which are in a row are surrounded by the transfer voltage application members on their upstream and downstream sides. This reduces interference by the secondary transfer bias voltage and prevents image quality deterioration.

According to another aspect of the invention, the image forming apparatus has: a medium transfer electrode member which applies transfer voltage to the belt transfer member in order to transfer overlapping, transferred visible images to a recording medium such as paper at a time; a backup roller which is located opposite to the medium transfer electrode member with the belt transfer member between them; a tension roller which is located between the drive roller and the backup roller to apply tension to the belt transfer member; and an electrical isolation structure which electrically isolates the intermediate transfer electrode members and the image holders, which are in contact with the belt transfer member, from the medium transfer electrode member.

In the electrical isolation structure, the drive roller and the backup roller are electrically floating, the tension roller is electrically grounded, and there is an electrically grounded grounding roller opposite to a cleaning member located between the backup roller and an adjacent image holder with the belt transfer member between the cleaning member and the grounding roller. Here, the tension roller is almost at the midpoint between the drive roller and the back up roller. Hence, the primary transfer area and the secondary transfer area of the intermediate transfer belt are electrically isolated by the grounding roller and the tension roller; therefore, even if primary transfer and secondary transfer take place simultaneously, an electrical influence can be prevented and stability in transfer can be assured. Further, since the drive roller and the tension roller are electrically floating, loss of current in application of transfer voltage can be prevented.

According to another aspect of the invention, the image forming apparatus is characterized in that the following relation exists between a number m of image holders and a number n of intermediate transfer electrode members: $n<m$, and $n<1$. Since the intermediate transfer electrode members are located away from the transfer nips as the belt contact points of the photosensitive drums, they may be located between image holders. As a result, a single-pass multicolor transfer process can be achieved by means of intermediate transfer electrode members which are fewer than image holders. Therefore, the number of intermediate transfer electrode members is smaller than in the conventional process in which the number of intermediate transfer electrode members should be the same as the number of image holders, namely the number of colors; and the problem of high cost in the single-pass type system is alleviated.

Here, a surface resistance of the belt transfer member is, for example, in a range from $5\times10^8$ Ω/□ to $5\times10^{10}$ Ω/□. The intermediate transfer electrode member may be made of metal. Specifically, the intermediate transfer electrode member is a metal roller, a metal brush, a metal sheet, a metal shaft, a metal block, a metal plate or a metal blade.

According to another aspect of the invention, there is provided an imaging method characterized in that it has the following steps: an image forming step of forming visible images of different colors by making developers of different colors adhere to image holders electrostatically; and an intermediate transfer step of sequentially transferring the different color images adhering to the image holders onto a belt transfer member electrostatically and making the transferred images overlap each other, and that at the intermediate step, transfer voltage is applied on a belt surface at places away from points at which the image holders contact the belt.

BRIEF DESCRIPTION OF THE DRAWINGS

Preferred embodiments of the invention will be described in detail based on the followings, wherein.

DETAILED DESCRIPTION OF THE PREFERRED EMBODIMENTS

Figure 1:
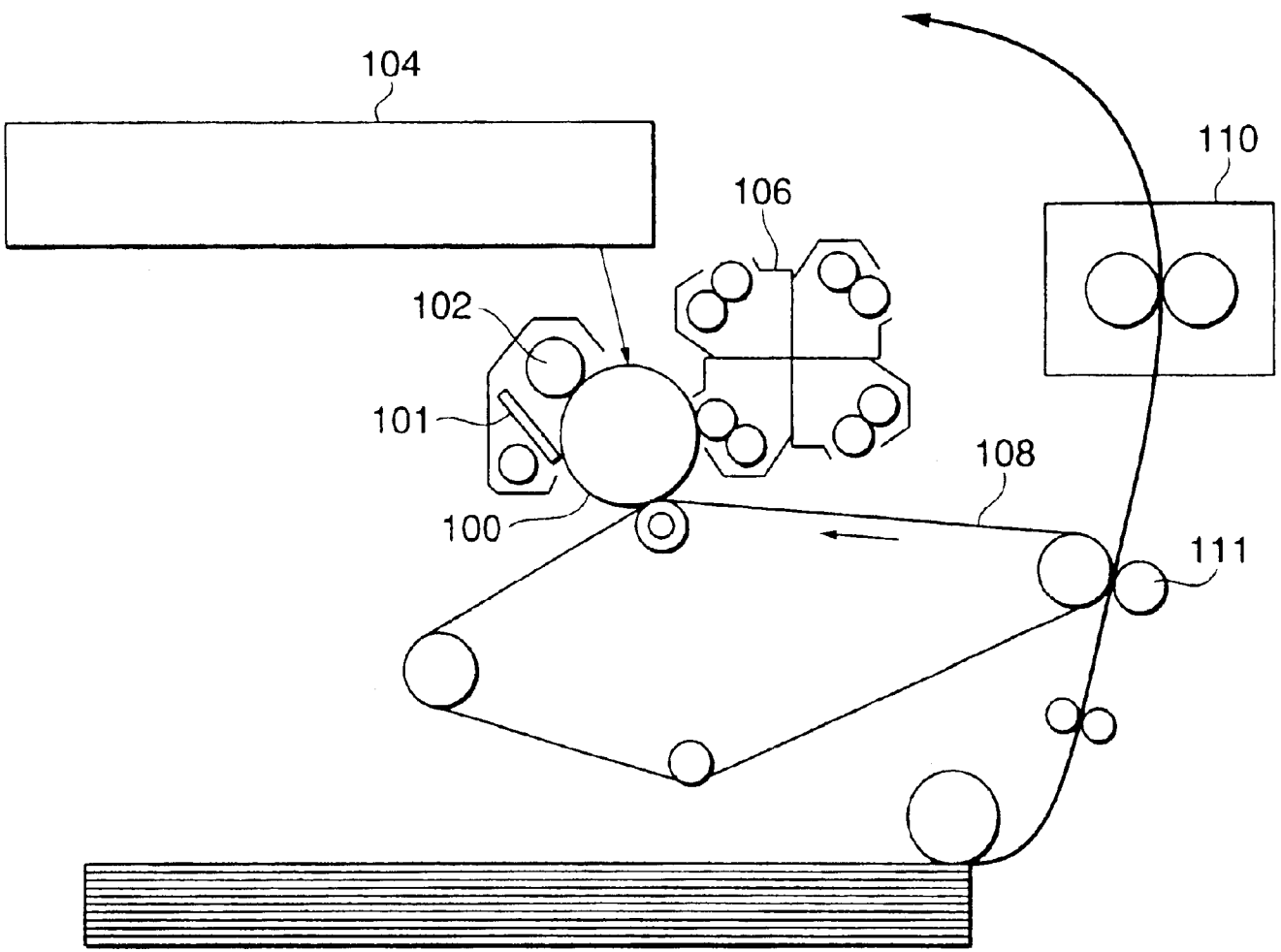
FIG. 1 PRIOR ART
FIG. 1 illustrates the process of the conventional four-pass system.
Figure 2:
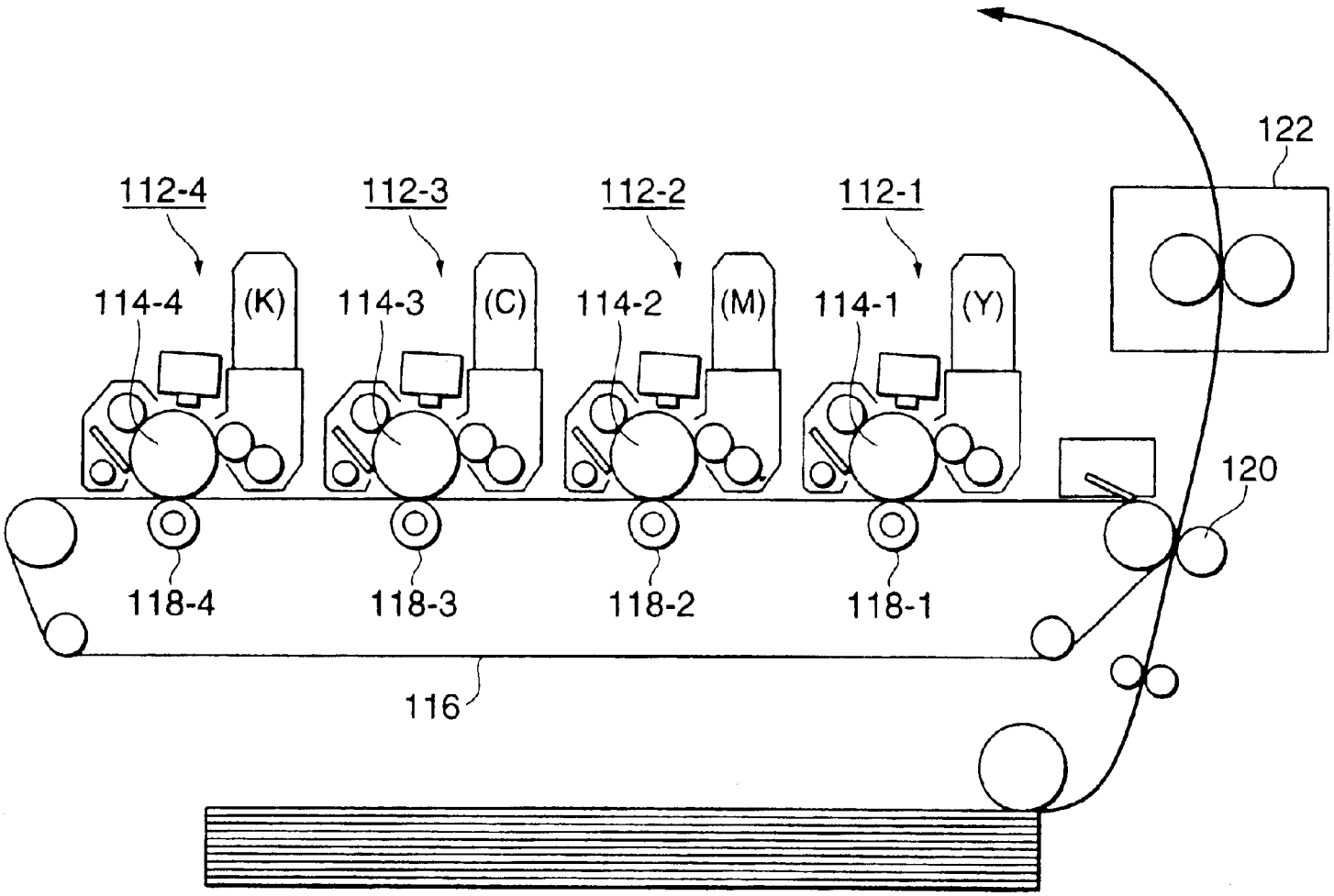
PRIOR ART FIG. 2
FIG. 2 illustrates the process of the conventional single-pass system.
Figure 3:
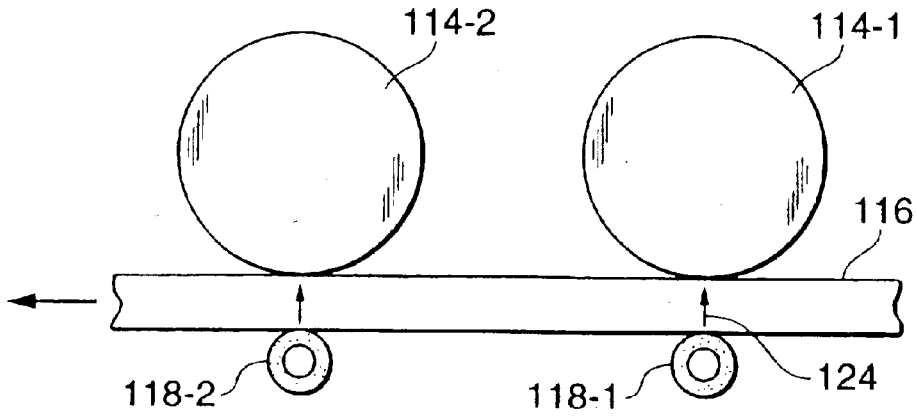
FIG. 3 PRIOR ART
FIG. 3 illustrates how the volume resistance of the intermediate transfer belt is employed to apply transfer voltage in the conventional system.
Figure 4:
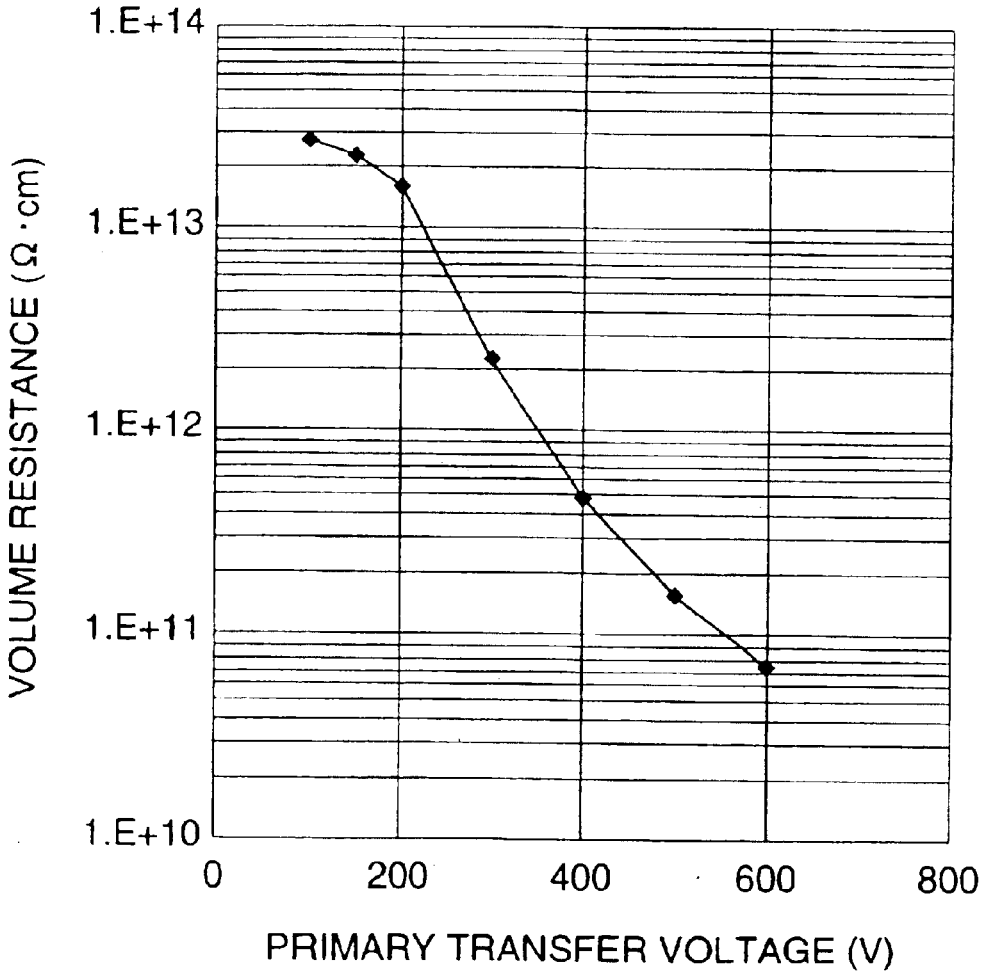
FIG. 4 PRIOR ART
FIG. 4 is a graph showing the volume resistance of the belt shown in FIG. 3 versus transfer voltage as a result of measurement.
Figure 5:
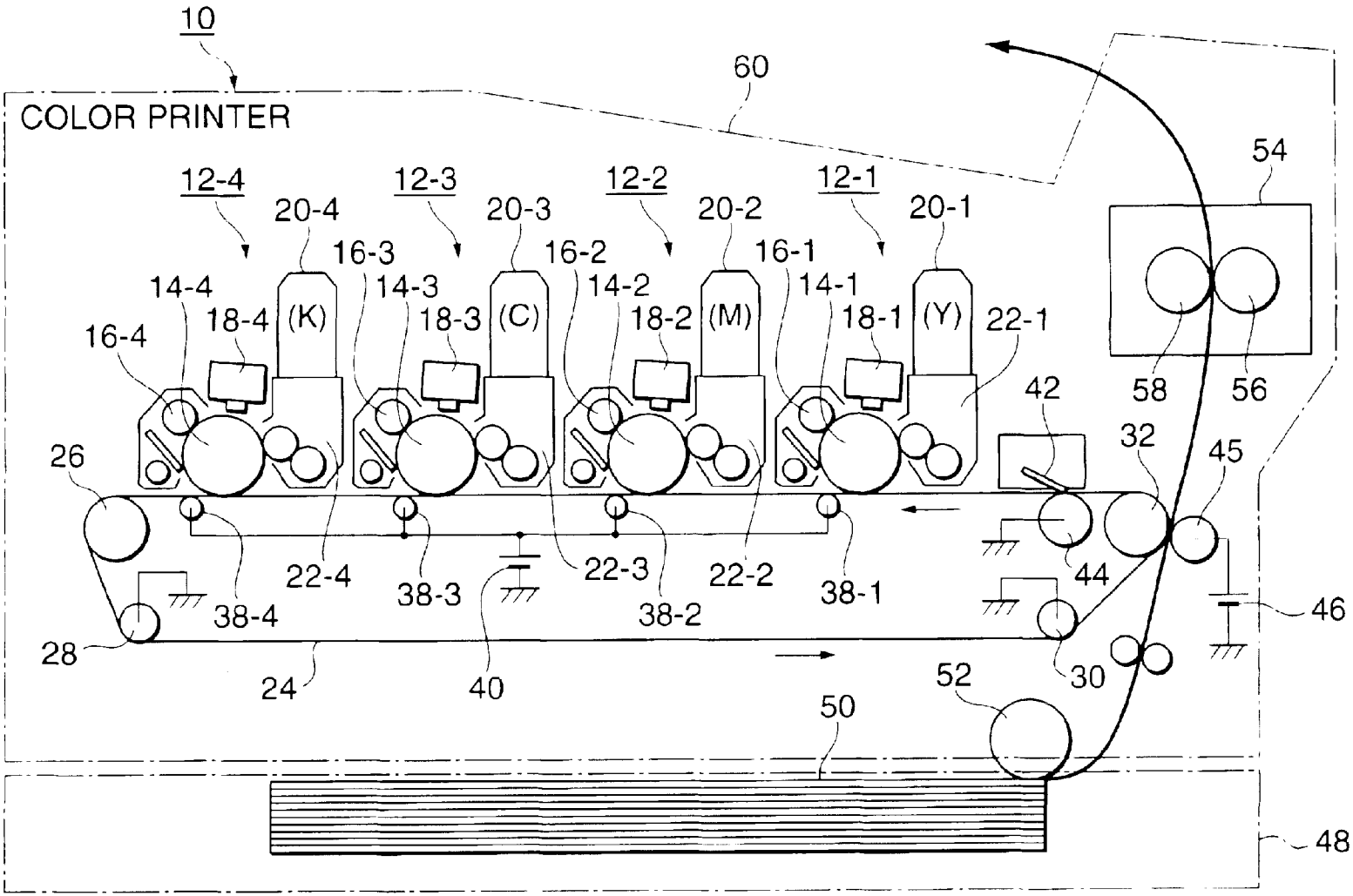
FIG. 5 shows an embodiment of the present invention.

FIG. 5 shows an image forming apparatus according to an embodiment of the invention, which is suitable as a color printer. Referring to FIG. 5, a color printer 10 incorporates an intermediate transfer belt 24 which is used as an intermediate transfer member. The intermediate transfer belt 24 is looped around a drive roller 26, tension rollers 28, 30 and a backup roller 30 as a driven roller and rotated counterclockwise (as viewed in this FIGURE) as a motor turns the drive roller 26. Above the intermediate transfer belt 24 are provided from upstream (right) to downstream (left) an image forming unit for yellow (Y) 12-1, one for magenta (M) 12-2, one for cyan (C) 12-3, and one for black (K) 12-4 in the order of mention. The image forming units 12-1 through 12-4 respectively have photosensitive drums 14-1, 14-2, 14-3, and 14-4 as image holders. Provided around the photosensitive drums 14-1 through 14-4 are chargers 16-1 through 16-4, LED arrays 18-1 through 18-4, and developing devices 22-1 through 22-4 with toner cartridges 20-1 through 20-4. Also there are cleaning blades and dischargers before the chargers 16-1 through 16-4. The photosensitive drums 14-1 through 14-4 in the image forming units 12-1 through 12-4 are in contact with the intermediate transfer belt 24 at their bottoms, and opposite to the points at which the drums contact the belt are intermediate transfer rollers 38-1 through 38-4, with the belt 24 between the drums and rollers. These rollers are used as intermediate transfer electrode members to apply primary transfer voltage. According to the present invention, the intermediate transfer rollers 38-1 through 38-4 are located on the belt surface away from the points at which the photosensitive drums 14-1 through 14-4 contact the intermediate transfer belt 24, namely "transfer nips," and are in contact with the belt 24. In the embodiment shown in FIG. 5, the intermediate transfer rollers 38-1 through 38-4 are on the belt downstream from the corresponding transfer nips as the belt contact points of the drums 14-1 through 14-4. A prescribed voltage in the range of +500V to 1000V is supplied from a power supply 40 to the intermediate transfer rollers 38-1 through 38-4 at the time to start primary transfer.

The backup roller 32, which is located on the opposite side of the drive roller 26 or upstream of the intermediate transfer belt 24, faces a paper transfer roller 45 with the belt 24 between them to apply secondary transfer voltage. The paper transfer roller 45 is connected with a constant current power supply 46 to apply a prescribed bias voltage at the time to start secondary transfer so that a finished color image from the intermediate transfer belt 24 is transferred onto paper 50 fed out from a hopper 48 by a pickup roller 52. The paper on which a transfer of the image has been made by the paper transfer roller 45 enters a fixing device 54 where the transferred image is fixed by heating, before being delivered to a stacker 60. The fixing device 54 has a heat roller 56 and a backup roller 58.

Between the backup roller 32 on the upstream of the intermediate transfer belt 24 and the first image forming unit 12-1 for yellow toner is a cleaning blade 42 which faces a grounding roller 44 with the intermediate transfer belt 24 between the cleaning blade 42 and the roller. The grounding roller 44 is electrically grounded. Located between the drive roller 26 and the backup roller 32, the tension rollers 28, 30 give a prescribed level of tension to the intermediate transfer belt 24. These tension rollers 28, 30 are also electrically grounded. Unlike the grounding roller 44 and tension rollers 28, 30, which are grounded, the drive roller 26 and backup roller 32 are electrically floating.

Further details of the color printer 10 are explained next. Each of the photosensitive drums 14-1 through 14-4 in the image forming units 12-1 through 12-4 is, for example, an aluminum pipe with an outer diameter of 30 mm which is coated with a 25-$\mu$m thick photosensitive layer having a charge generation layer and a charge transport layer. In the imaging process, the drum surfaces are evenly charged by the chargers 16-1 through 16-4. In the chargers 16-1 through 16-4, conductive brushes are made to touch the surfaces of the photosensitive drums 14-1 through 14-4 and a charging bias (for example, 800 Hz, 1100 V PP voltage, −650 V offset voltage) is applied to charge the photosensitive drum surfaces to approximately −650 V. In the charging process, a corona charger or solid roller charger may be used instead. Once the photosensitive drums 14-1 through 14-4 have been charged or electrified, exposures appropriate to colors are made by means of the LED arrays 18-1 through 18-4 located next to form electrostatic latent images on the surfaces of the drums. It is also possible to use laser scanning exposure devices instead of the LED arrays 18-1 through 18-4. After formation of electrostatic latent images on the photosensitive layers of the drums 14-1 through 14-4, the developing devices 22-1 through 22-4 develop the photosensitive layers using color toners to turn the electrostatic latent images into visible images. This embodiment employs the nonmagnetic monocomponent development method. Needless to say, the development method is not limited thereto. Also, the toner charge polarity is not limited to the negative polarity.

Next is an explanation of the primary transfer process of transfer to the intermediate transfer belt 24, which follows the formation of four monochrome toner images on the photosensitive drums 14-1 through 14-4 by the image forming units 12-1 through 12-4. The yellow, magenta, cyan, and black monochrome images formed by the image forming units 12-1 through 12-4 are transferred to the intermediate transfer belt 24 sequentially in a way to overlap each other to make up a finished color image. The time when the LED arrays 18-1 through 18-4 start writing is adjusted so that the monochrome color images coincide with each other accurately. The images are transferred electrostatically from the photosensitive drums 14-1 through 14-4 to the intermediate transfer belt 24 by applying a prescribed level of primary transfer voltage (in the range from +500 V to +1000 V) to the intermediate transfer rollers 38-1 through 38-4. The intermediate transfer belt 24 is made of 150 $\mu$m thick polycarbonate resin whose resistance is adjusted with carbon. Its volume resistance is adjusted to a value in the range from 1 E+8 ohm-cm to 1 E+10 Ω□($1\times10^8$ Ω/□to $1\times10^{10}$ Ω/□) and its surface resistance to a value in the range from 1 E+8 ohm-cm to 1 E+10 Ω/□ ($1\times10^8$ Ω/□ to $1\times10^{10}$ Ω/□). Typically the intermediate transfer belt 24 is used under the condition that the volume resistance is almost in the range from 1 E+6 Ω·cm to 1 E+11 Ω·cm and the surface resistance is almost in the range from 1 E+6 Ω/□to 1 E+11 Ω/□. In the present invention, as far as the belt is a resistor belt, it may be used under the condition that the resistances are within the typical resistance ranges. In that case, it is necessary to adjust the voltage to be applied to the intermediate transfer rollers 38-1 through 38-4 according to the resistances of the intermediate transfer belt 24 which depend on the distance between the intermediate transfer rollers 38-1 through 38-4 and the transfer nip as the belt contact point of each of the photosensitive drums 14-1 through 14-4. The material of the intermediate transfer belt 24 is not limited to polycarbonate resin; it may be polyimide, nylon or fluorocarbon resin.

Next is an explanation of the secondary transfer process. The color image formed on the intermediate transfer belt 24 is transferred by secondary transfer through the paper transfer roller 45 to a recording medium, for example, paper 50, on the basis of four monochrome images at a time. The paper transfer roller 45, which functions as a secondary transfer roller, is a sponge roller whose resistance between its central shaft and roller surface is in the range from 1 E+5 Ω·cm to 1 E+8 Ω·cm. It is held pushed against the backup roller 32 with a pressure ranging from 0.5 kg to 3 kg or so with the intermediate transfer belt 24 between them. The sponge roller hardness should be between Asker C 40 and 60. In the secondary transfer process, a prescribed bias voltage is supplied to the paper transfer roller 45 by the constant current power supply 46 so that the color image on the intermediate transfer belt 24 is electrostatically transferred to the paper 50 fed out timely by the pickup roller. The transferred color image on the paper 50 is passed through the fixing device 54 which has a heat roller 56 and a backup roller 58 and the developers are thermally fixed on the paper 50 to fix the image; finally the paper is delivered to the stacker 60. In this color printing process in the color printer 10 which includes a series of steps as mentioned above, the printing speed, namely the paper feeding speed which depends on the speed of the intermediate transfer belt 24, is, for example, 91 mm/s. The paper feeding speed is not limited thereto. Even when it is half as much as that, or 45 mm/s, a similar printing result can be obtained. The printing speed may also be higher than that.

Figure 6:
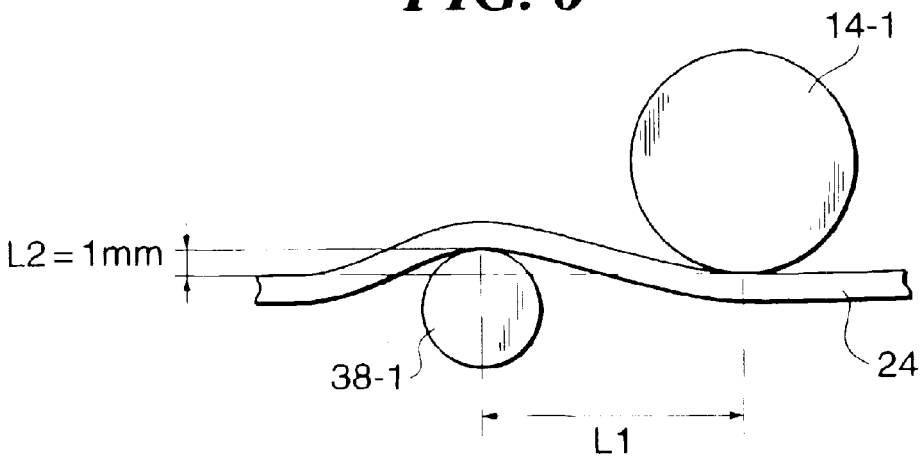
FIG. 6 shows the positional relationship between the photosensitive drum and intermediate transfer roller which are shown in FIG. 5.

Details of the primary transfer process in the color printer 10 (FIG. 5) are given below. The intermediate transfer rollers 38-1 through 38-4 as primary transfer rollers are made of stainless steel and, for example, rotary metal rollers with an outer diameter of 8 mm. FIG. 6 shows the positional relation of the photosensitive drum 14-1 in the image forming unit 12-1 (located most upstream in FIG. 5) and the corresponding intermediate transfer roller 38-1 with respect to the intermediate transfer belt 24. Distance L1 between the centerline vertically extended downward from the center of the photosensitive drum 14-1 and the centerline vertically extended downward from the center of the intermediate transfer roller 38-1 is, for example, 10 mm. The intermediate transfer roller 38-1 is located downstream from the transfer nip, namely the point of contact between the photosensitive drum 14-1 and the intermediate transfer belt 24, in the belt advance direction. Vertically the intermediate transfer roller 38-1 is positioned in a way that the interval L2 between the top of its centerline and the tangent to the centerline at the bottom of the photosensitive drum 14-1 is 1 mm or more. This arrangement allows the intermediate transfer belt 24 to contact the photosensitive drum 14-1 with a winding angle in a way to obtain a transfer nip width of 1 mm or so. The same positional relation (between the photosensitive drum 14-1 and the intermediate transfer roller 38-1) exists for the other photosensitive drums 14-2 through 14-4 and the corresponding intermediate transfer rollers 38-2 through 38-4.

Figure 7A:
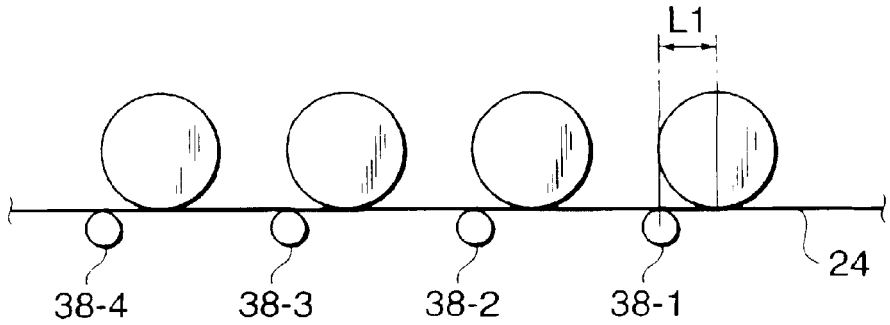
FIGS. 7A and 7B are respectively a sectional view and a bottom view which show the primary transfer section of the system shown in FIG. 5.
Figure 7B:
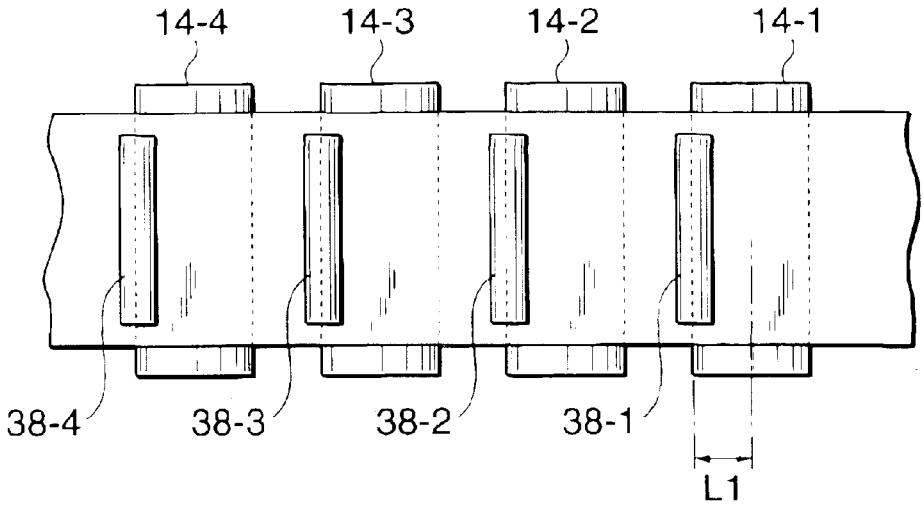

FIG. 7A and FIG. 7B are respectively a sectional view and a bottom view showing the four color photosensitive drums 14-1 through 14-4 and the intermediate transfer rollers 38-1 through 38-4 in the color printer 10 (FIG. 5) where the rollers are opposite and away from the drums with the intermediate transfer belt 24 between them. As described above, the intermediate transfer rollers 38-1 through 38-4 are downstream away by the prescribed distance L1 from the transfer nips of the photosensitive drums 14-1 through 14-4 in contact with the intermediate transfer belt 24. As apparent from the bottom view of FIG. 7B, the intermediate transfer rollers 38-1 through 38-4 have a length which matches the width of an image which is narrower than the intermediate transfer belt 24.

Figure 8:
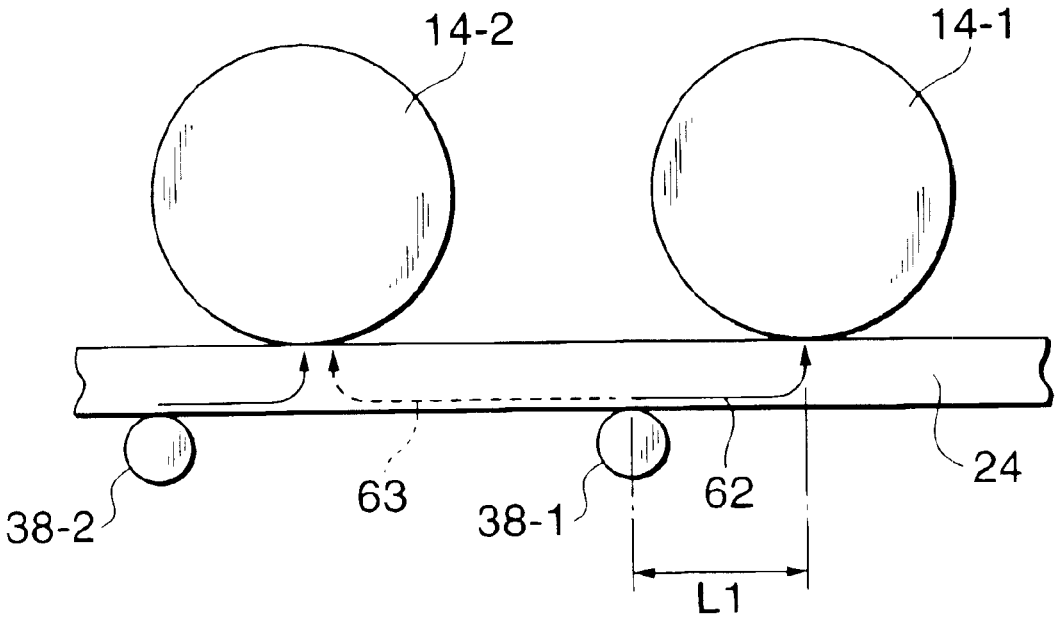
FIG. 8 illustrates how the surface resistance of the belt shown in FIG. 5 is employed to apply transfer voltage.

FIG. 8 shows how electric current flows to transfer nips when primary transfer voltage is supplied from the intermediate transfer rollers 38-1 and 38-2 which are away from the two upstream photosensitive drums 14-1 and 14-2 with the intermediate transfer belt 24 between them. Taking the intermediate transfer roller 38-1 as an example, when a prescribed d.c. voltage, for example, 500 V is applied to it, this voltage causes electric current to flow to the transfer nip, or belt contact point of the corresponding photosensitive drum 14-1 depending on the surface resistance of the belt 24 and then advance in the thickness direction, a direction in which the volume resistance is effective, as indicated by arrowed solid line 62. At the same time, as indicated by arrowed dotted line 63, electric current flows from the intermediate transfer roller 38-1 to the photosensitive drum 14-2 located on the downstream of it. In this case, the amperage of the currents as indicated by the arrowed lines 62 and 63 depends on the distance between the belt contact point of the intermediate transfer roller 38-1 and the transfer nips of the photosensitive drums 14-1 and 14-2. The shorter the distance is, the more current flows. This suggests that, in the primary transfer process according to the present invention, the current which flows to photosensitive drum transfer nips upon application of voltage to the intermediate transfer rollers depends on the belt surface resistance because it is electric current mainly in the belt surface direction.

Figure 9:
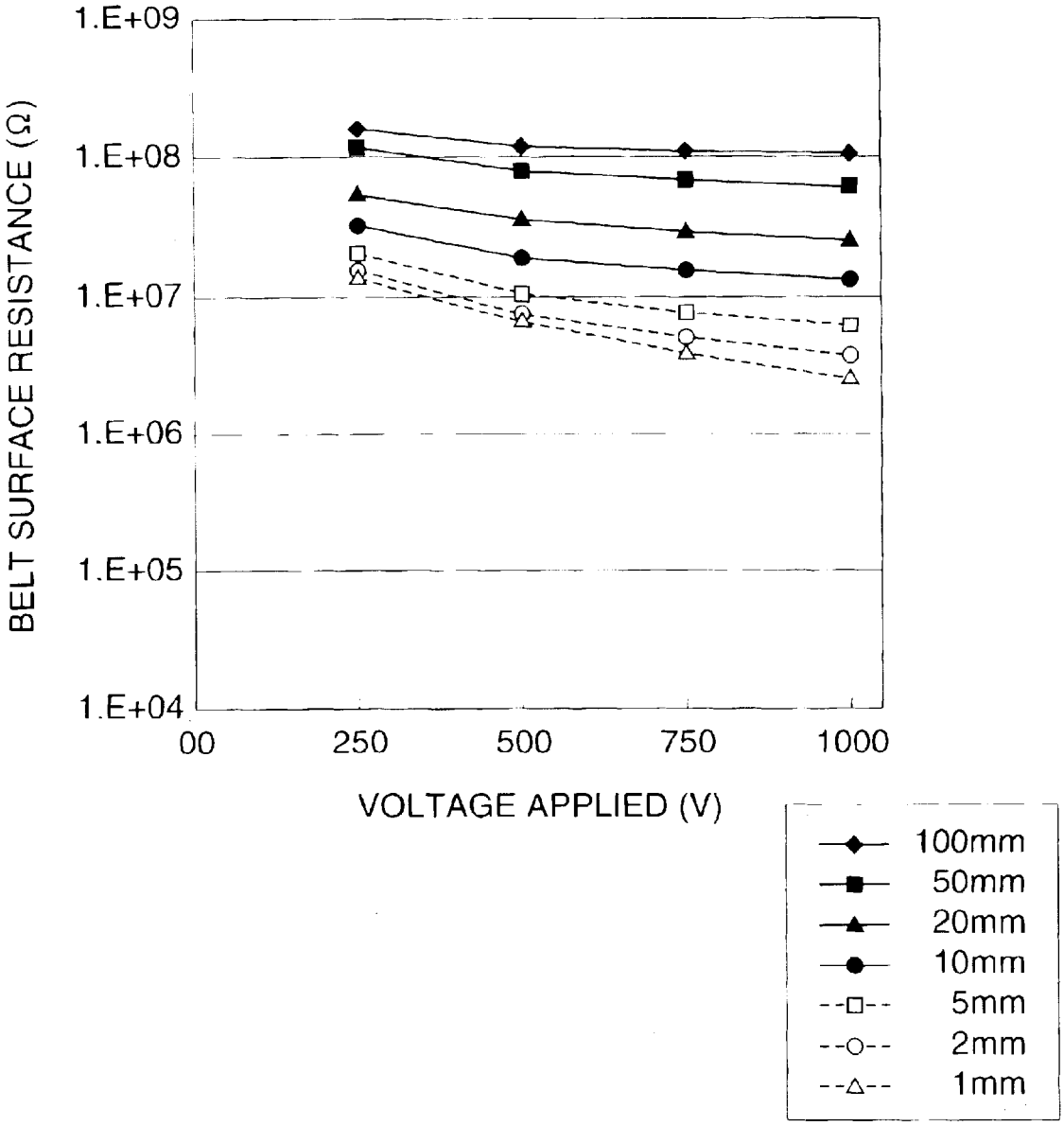
FIG. 9 is a graph showing the surface resistance of the belt shown in FIG. 8 versus transfer voltage as a result of measurement

FIG. 9 shows measured belt surface resistances in relation with the voltages applied to the intermediate transfer roller shown in FIG. 8 according to the present invention. The graph represents different cases concerning the distance L1 between the transfer nip and the point of transfer voltage application: 100 mm, 50 mm, 20 mm, 10 mm, 2 mm, or 1 mm. As can be seen from FIG. 9, whatever may be the distance L1, the belt surface resistance hardly differs at different applied voltages: 250 V, 500 V, 750V and 1000 V and it can be said that the surface resistance is very stable. Therefore, the intermediate transfer belt 24 hardly deteriorates over a long time in the primary transfer process according to the present invention because the stable surface resistances of the belt 24 as illustrated in FIG. 9 are employed to generate an electric field for transfer. For this reason, this prevents image blurring and assures stability in transfer.

FIGS. 10A, 10B, 11A, 11B, 12A, 12B, 13A and 13B show transfer efficiency versus transfer voltage where the distance between the intermediate transfer rollers 38-1 through 38-4 and the transfer nips of the photosensitive drums 14-1 through 14-4 varies from 10 mm to 45 mm on the downstream side. When the distance of the intermediate transfer rollers is 45 mm or so, it is almost a half the distance (90 mm) between neighboring drums. This means that each roller is almost at the midpoint between neighboring drums. The distance between neighboring drums is not limited to 90 mm, and may be freely set within an allowable range to suit each design need. Actually, when the need for compactness is taken into consideration, it is desirable to set the distance between drums to 90 mm or less.

Figure 10A:
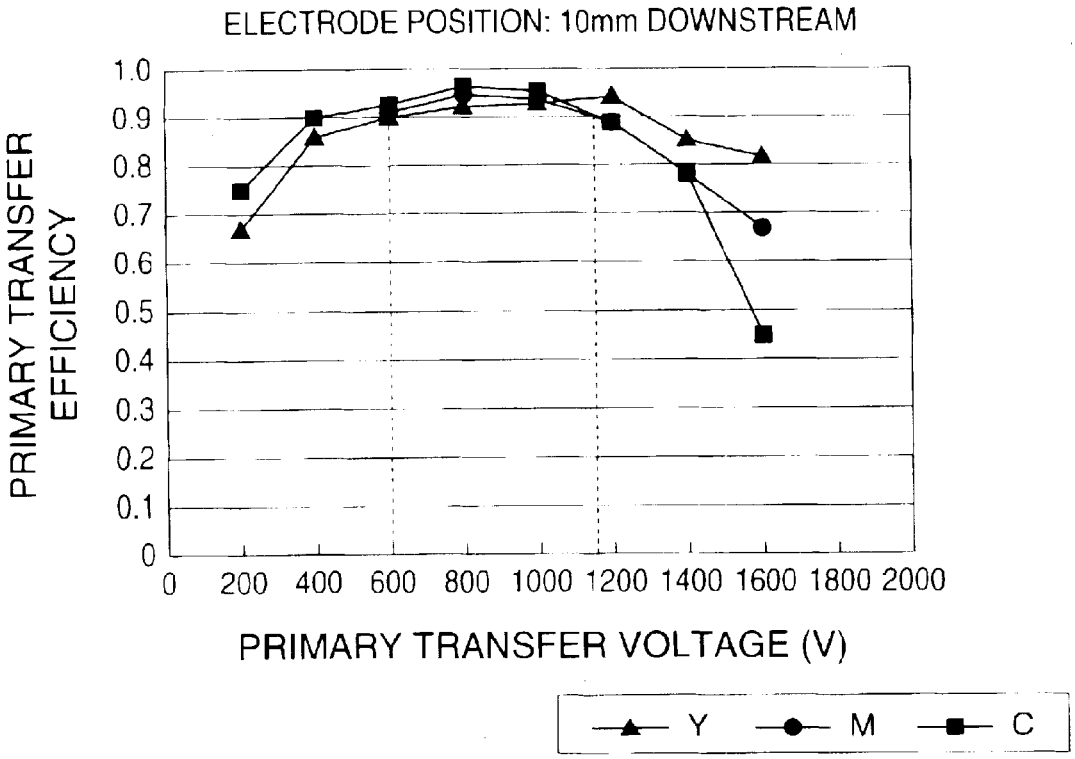
FIGS. 10A and 10B are characteristic graphs showing primary transfer efficiency versus primary transfer voltage in the case where each intermediate transfer roller is located 10 mm downstream from the corresponding transfer nip, wherein FIG. 10A concerns a first color and FIG. 10B concerns a second and a third color.
Figure 10B:
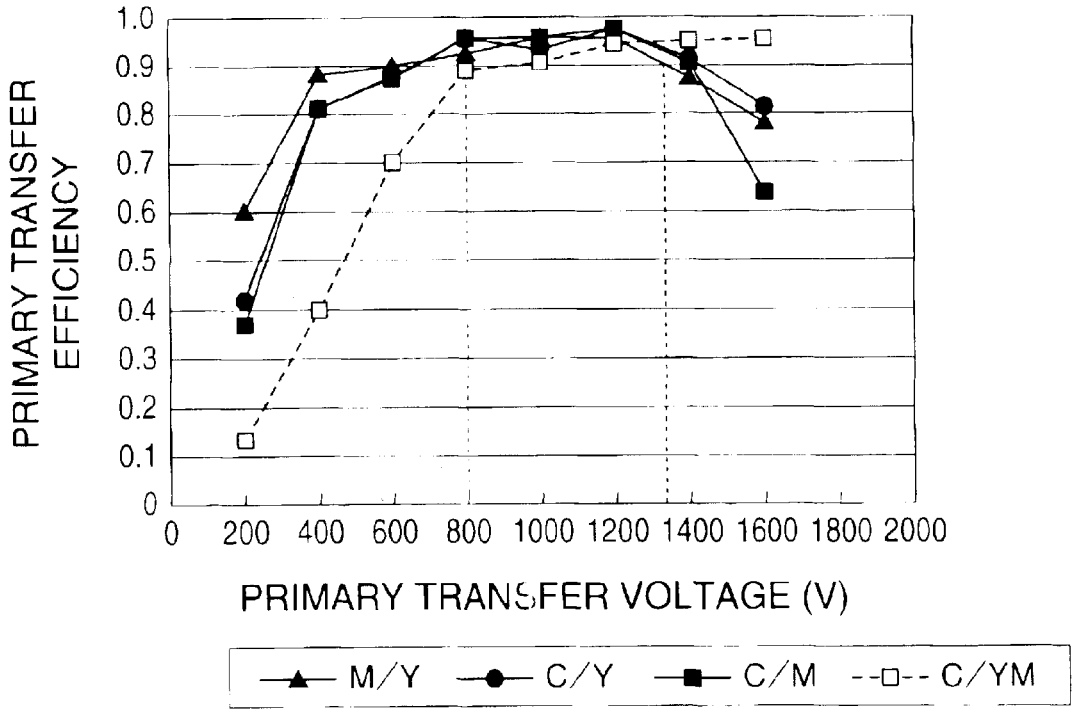
Figure 11A:
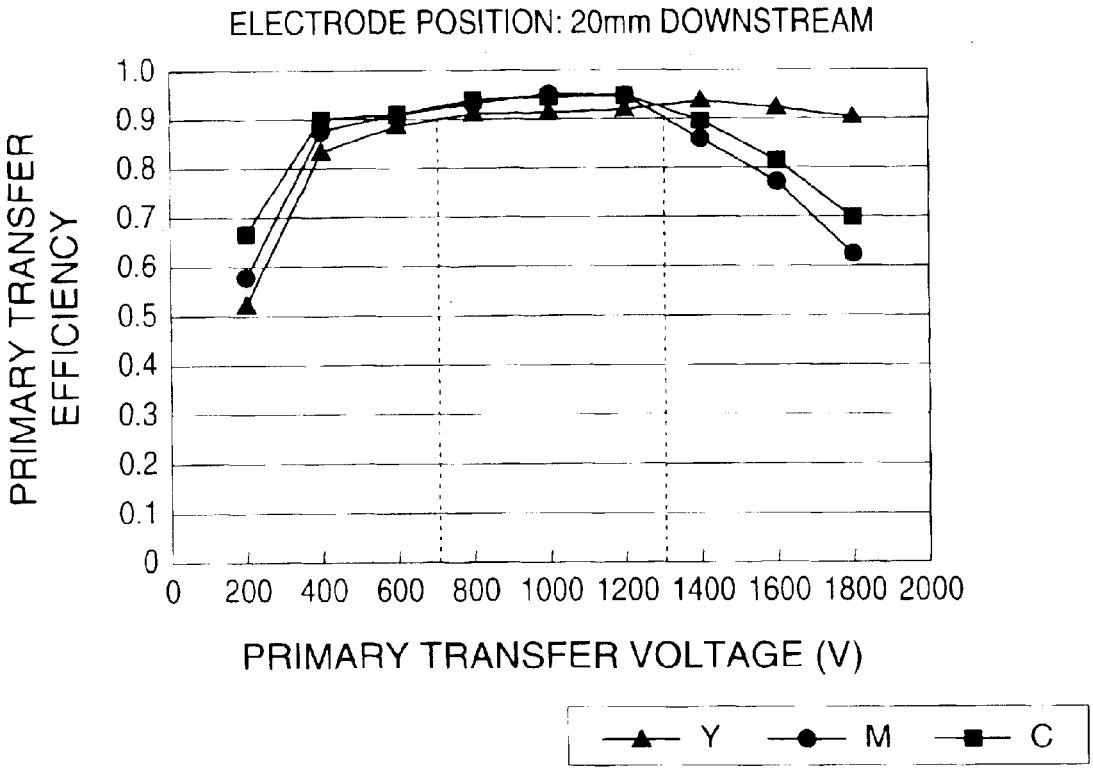
FIGS. 11A and 11B are characteristic graphs showing primary transfer efficiency versus primary transfer voltage in the case where each intermediate transfer roller is located 20 mm downstream from the corresponding transfer nip, wherein FIG. 11A concerns a first color and FIG. 11B concerns a second and a third color.
Figure 11B:
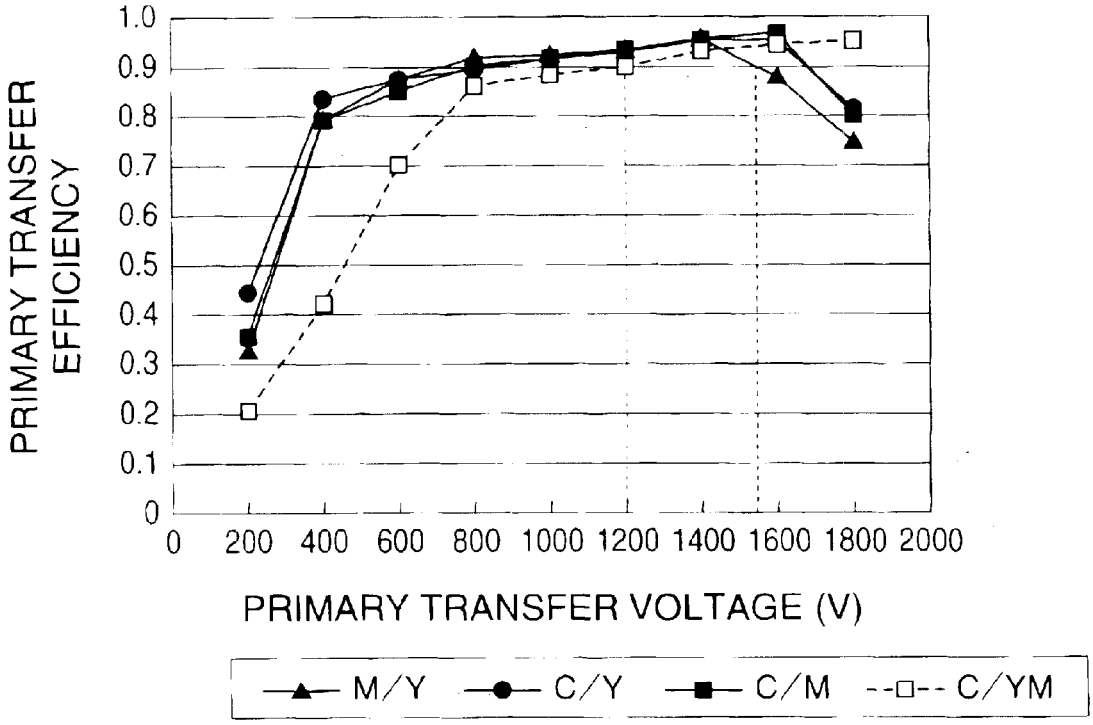
Figure 12A:
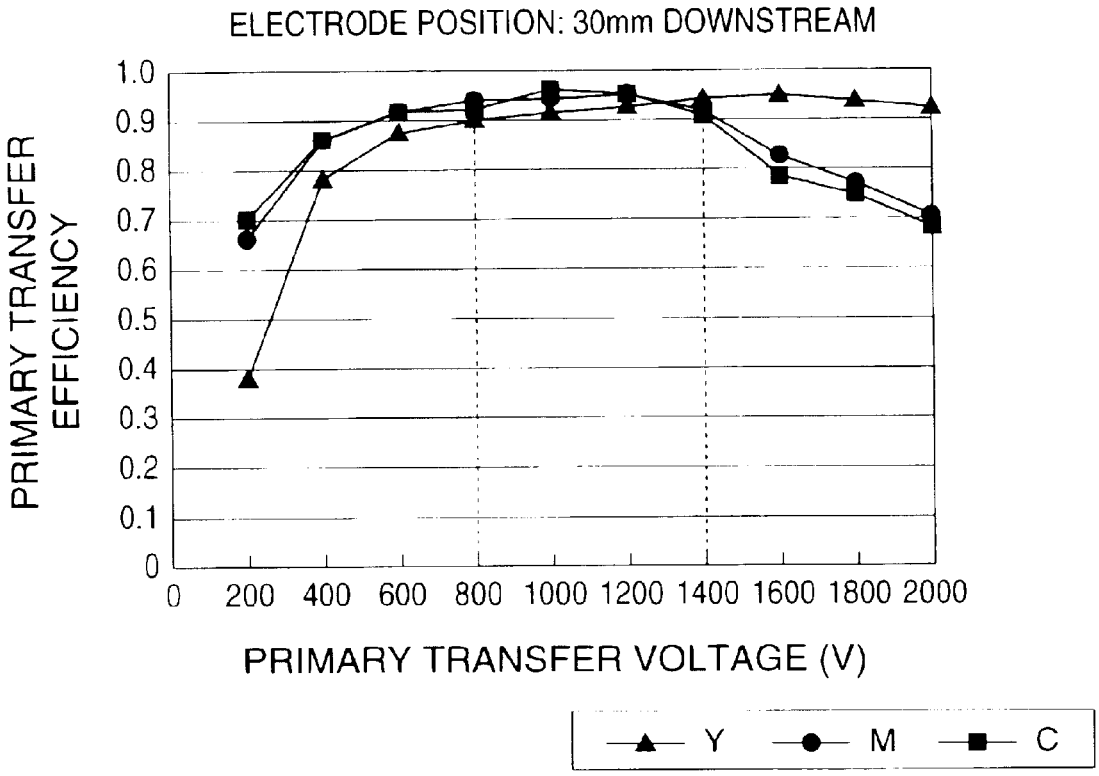
FIGS. 12A and 12B are characteristic graphs showing primary transfer efficiency versus primary transfer voltage in the case where each intermediate transfer roller is located 30 mm downstream from the corresponding transfer nip, wherein FIG. 12A concerns a first color and FIG. 12B concerns a second and a third color.
Figure 12B:
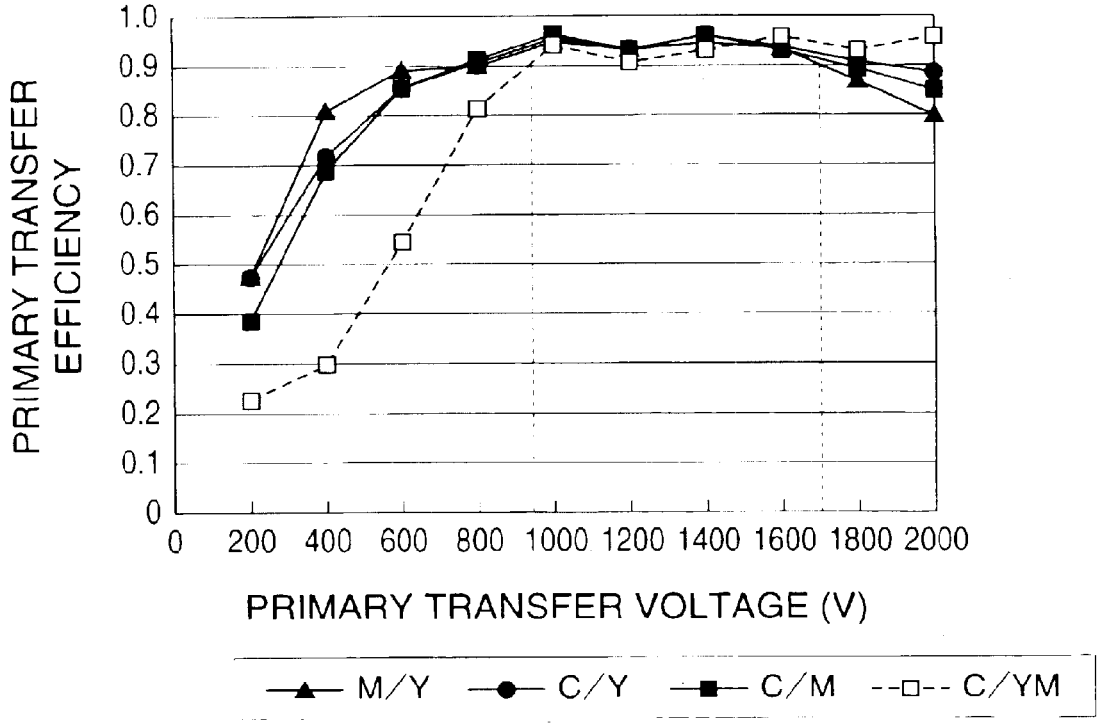
Figure 13A:
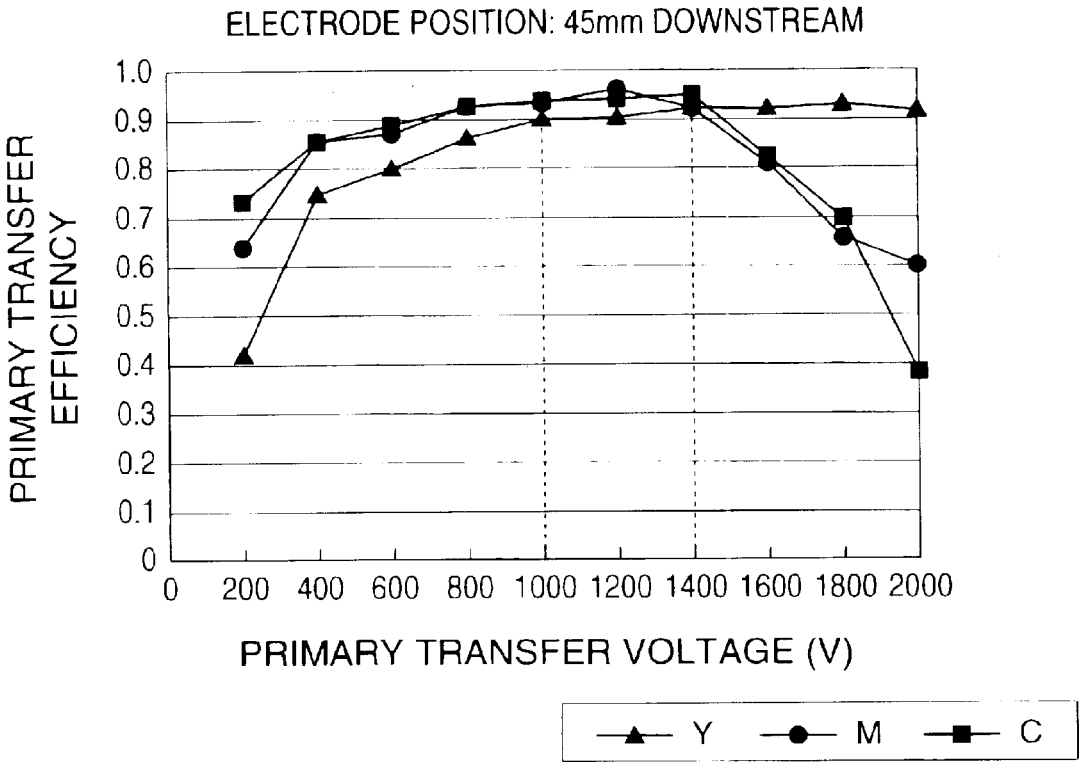
FIGS. 13A and 13B are characteristic graphs showing primary transfer efficiency versus primary transfer voltage in the case where each intermediate transfer roller is located 45 mm downstream from the corresponding transfer nip, wherein FIG. 13A concerns a first color and FIG. 13B concerns a second and a third color.
Figure 13B:
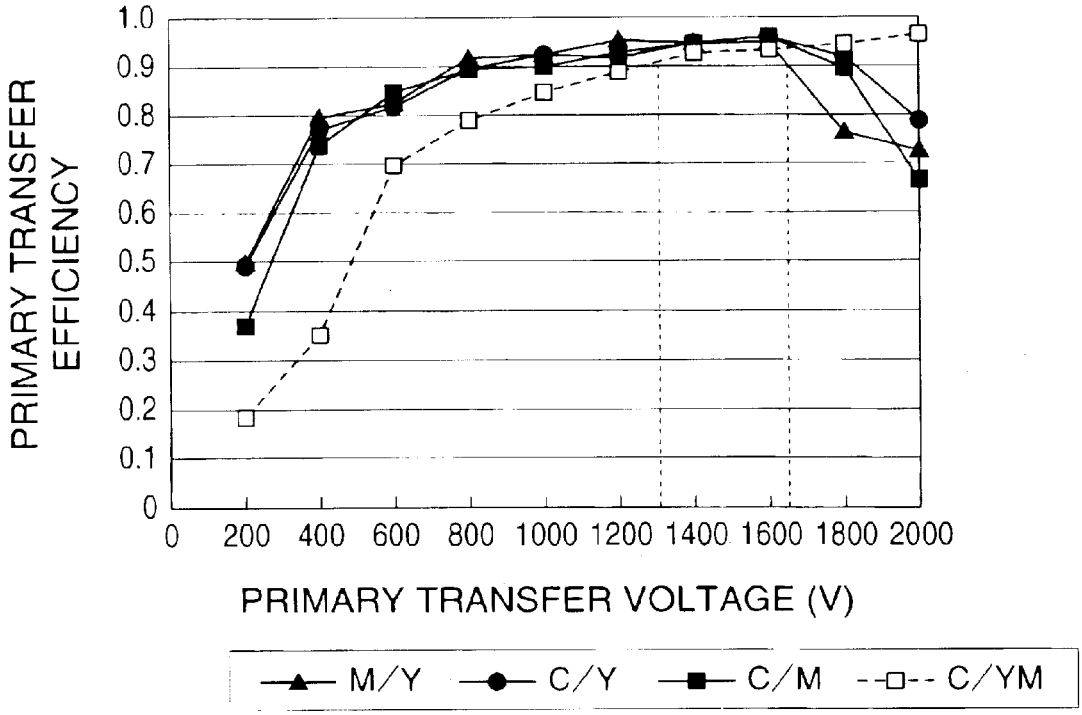

FIGS. 10A and 10B show transfer efficiency versus transfer voltage as a result of measurement in the case where each intermediate transfer roller is 10 mm downstream from the corresponding transfer nip. Here, the same transfer voltage is supplied to all the color rollers by the power supply 40 (see FIG. 5). Here, transfer efficiency is defined as a ratio of the amount of transferred toner on the belt to the amount of toner on the photosensitive drum which makes up a solid image (before transfer). If the transfer efficiency is 90% or more, it is considered adequate. In FIG. 10A, the Y, M, and C curves represent transfer efficiencies for monochrome images where Y, M and C represent toners for a first color. In FIG. 10B, M/Y represents the magenta toner as a second color over the yellow toner (first color) on the intermediate transfer belt; and C/YM represents the cyan toner as a third color over the yellow and magenta toners (first and second colors) on the belt. Similarly, C/M represents the cyan toner as a second color over the magenta toner and C/YM the cyan toner as a third color over the yellow and magenta toners. FIGS. 11A and 11B show transfer efficiency versus transfer voltage as a result of measurement in the case where each intermediate transfer roller is 20 mm downstream from the corresponding transfer nip: FIGS. 12A and 12B, 30 mm downstream; and FIGS. 13A and 13B, 45 mm downstream.

FIGS. 10A to 13B demonstrate that the adequate transfer efficiency range varies depending on the position of the intermediate transfer rollers. This is because the intermediate transfer belt distance from the transfer nip to the intermediate transfer roller differs depending on the position of the roller, and the voltage applied by the roller drops mainly due to the surface resistance of the intermediate transfer belt as a resistor, resulting in a drop in the effective voltage at the transfer nip where the photosensitive drum contacts the belt. This means that the position of each intermediate transfer roller, the resistances (surface resistance in particular) of the intermediate transfer belt, and the effective applied voltage at the transfer nip should be combined properly to set the optimum transfer conditions. Obviously the distance L1 from the intermediate transfer roller to the transfer nip as the belt contact point of the photosensitive drum is not limited to the range of 10 to 45 mm. Regarding the transfer voltages for the respective colors which are used in the primary transfer process, it is desirable that they have the same voltage characteristics to achieve similar transfer efficiencies. If that is the case, transfers of four colors can be made at the same voltage, namely by a single power supply and thus the power supply-related cost can be reduced. In the embodiment shown in FIG. 5, since the intermediate transfer rollers 38-1 through 38-4 for the four color toners are located downstream from the transfer nips of the photosensitive drums 14-1 through 14-4 in the same manner respectively, the transfer efficiency versus voltage characteristics for the respective colors have almost the same tendency and thus it can be said that the use of only the power supply 40 has no problem. What is essential here is that the effective voltage at the transfer nip for each color should fall within the voltage margin for adequate transfer efficiency and the voltage margins for the four colors overlap. It is needless to say that different power supplies may be used for different colors or the distance between the intermediate transfer roller and the transfer nip need not be the same for all the colors but may differ depending on the color.

Next, an explanation is given concerning how the secondary transfer area and primary transfer area of the intermediate transfer belt 24 in the color printer 10 (FIG. 5) are electrically isolated. The intermediate transfer belt 24 as a resistor is stretched by the drive roller 26 and the backup roller 32 which are electrically floating or not grounded. This prevents current leakage from the drive roller 26 and the backup roller 32 when the power supply 40 supplies primary transfer voltage to the intermediate transfer rollers 38-1 through 38-4, leading to reduction in leak current and prevention of loss of current. The intermediate transfer belt 24 is also in contact with the intermediate transfer rollers 38-1 through 38-4 for primary transfer and the paper transfer roller 45 for secondary transfer. Therefore, there is a possibility that application of secondary transfer voltage by the paper transfer roller 45 may occur at the same time when primary transfer voltage is applied.

To solve this problem, the present invention has a grounding roller 44 (electrically grounded) between the paper transfer roller 45 to be supplied with the secondary transfer voltage and the most upstream intermediate transfer roller 38-1 to be supplied with the primary transfer voltage. Furthermore, the tension rollers 28 and 30, which lie between the drive roller 26 and the backup roller 32, are electrically grounded in order to isolate the two areas of the intermediate transfer belt 24 electrically: an area where primary transfer voltage is applied through the intermediate transfer rollers 38-1 through 38-4, and an area where secondary transfer voltage is applied from the paper transfer roller 45. This prevents interference between the primary transfer voltage and secondary transfer voltage.

Figure 14:
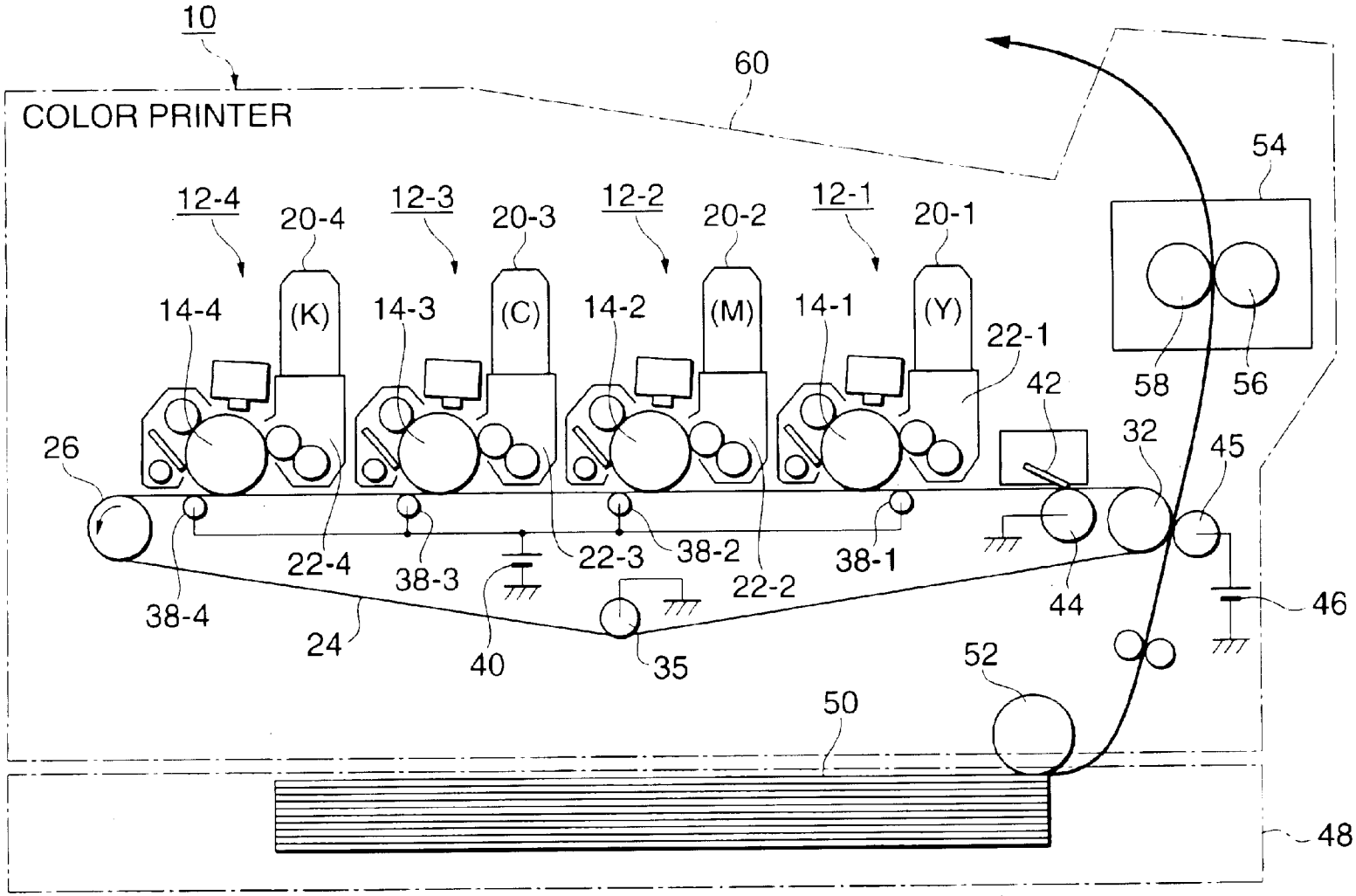
FIG. 14 illustrates another embodiment of the present invention.

FIG. 14 shows a color printer as an image forming apparatus according to another embodiment of the present invention. In the color printer 10 shown in FIG. 14, the intermediate transfer belt 24 is stretched by three rollers: the drive roller 26, backup roller 32 and tension roller 35 for the purpose of reducing the space requirement for the belt. As in the embodiment shown in FIG. 5, the intermediate transfer rollers 38-1 through 38-4 for primary transfer are opposite and away from the photosensitive drums 14-1 through 14-4 in the image forming units 12-1 through 12-4 with the intermediate transfer belt 24 between them, and also the intermediate transfer rollers on the downstream side 38-2 through 38-4 are located downstream from the corresponding transfer nips as in the embodiment in FIG. 5. The difference from the embodiment in FIG. 5 is that the most upstream intermediate transfer roller 38-1 is located upstream from the transfer nip of the photosensitive drum 14-1.

Figure 15:
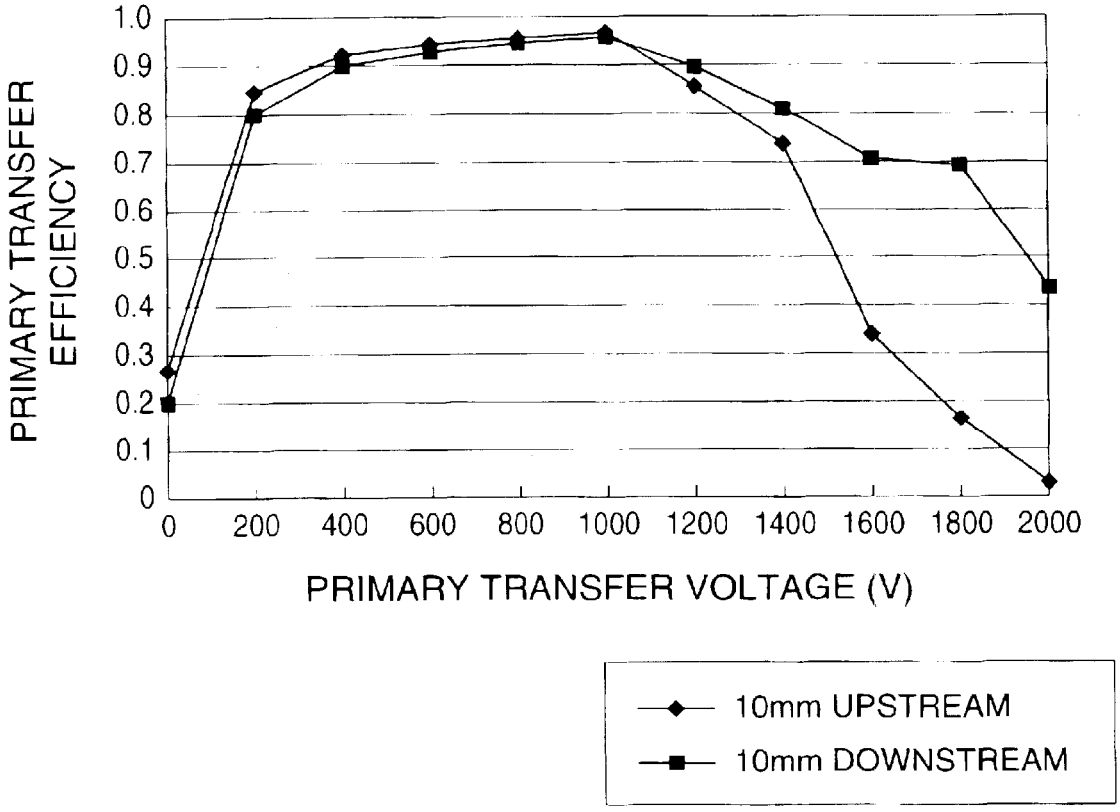
FIG. 15 is a characteristic graph showing primary transfer efficiency versus primary transfer voltage in the case where an intermediate transfer roller is located 10 mm upstream from the corresponding transfer nip.

FIG. 15 shows transfer efficiency versus primary transfer voltage as a result of measurement in the case where the intermediate transfer roller 38-1 is located 10 mm upstream from the transfer nip of the photosensitive drum 14-1 as illustrated in FIG. 14. In this case, the transfer efficiency is higher than in the cases of FIG. 10A to FIG. 13B (all the intermediate transfer rollers are downstream from the transfer nips of the corresponding drums) when the transfer voltage is below 1000 V but lower when the transfer voltage is over 1000 V. It has thus been confirmed that generally there is a transfer voltage margin for adequate transfer efficiency when all the intermediate transfer rollers are downstream from the transfer nips of the photosensitive drums but also there is still a voltage margin for adequate transfer efficiency even when any of them is upstream from the corresponding transfer nip. This means that according to the present invention, the intermediate transfer rollers may be not only downstream but also upstream from the transfer nips. Therefore, it is acceptable to have such an arrangement as shown in FIG. 14: one roller is upstream and the other rollers are downstream. This arrangement has the following advantage. When the most upstream intermediate transfer roller 38-1 is upstream from the transfer nip of the photosensitive drum 14-1 as illustrated in FIG. 14, the upstream-to-downstream area for the transfer nips as the belt contact points of the photosensitive drums 14-1 through 14-4, namely an area where images are transferred onto the intermediate transfer belt 24, is surrounded by the intermediate transfer rollers 38-1 and 38-2. This reduces interference with the intermediate transfer belt 24 which may be caused by the secondary transfer bias voltage applied through the paper transfer roller 46, so that image quality deterioration can be prevented.

Figure 16A:
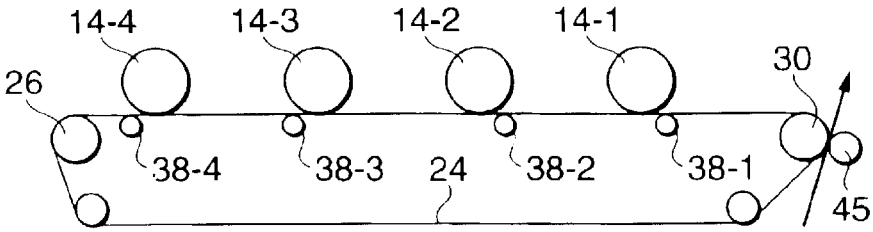
FIG. 16A through FIG. 16F show other various arrangements of the intermediate transfer rollers according to the present invention.
Figure 16B:
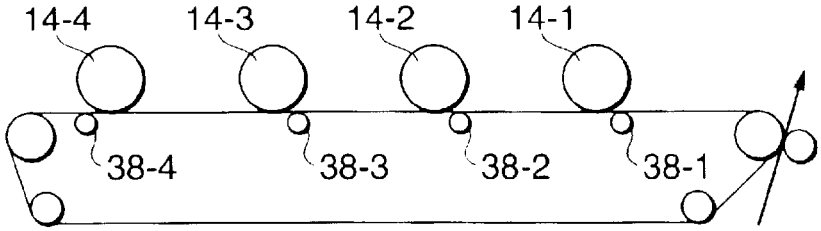
Figure 16C:
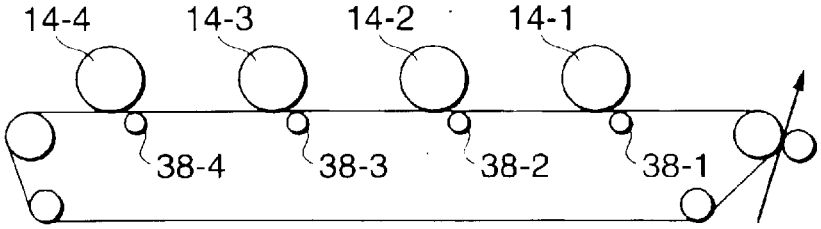
Figure 16D:
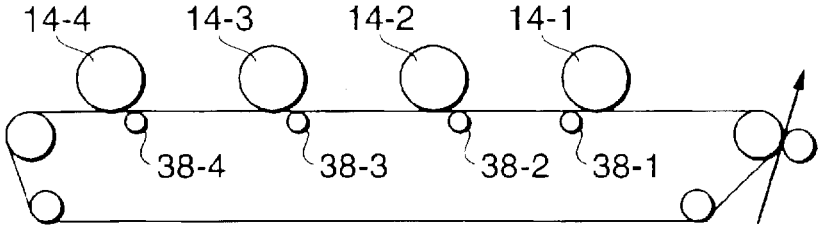
Figure 16E:
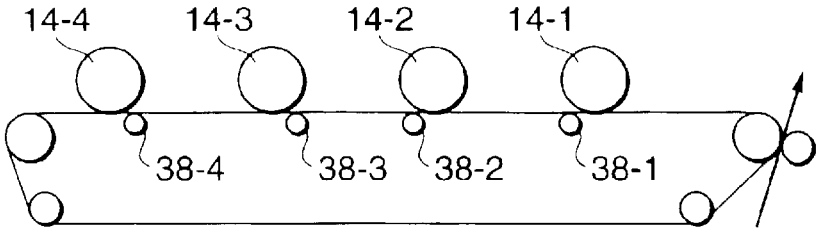
Figure 16F:
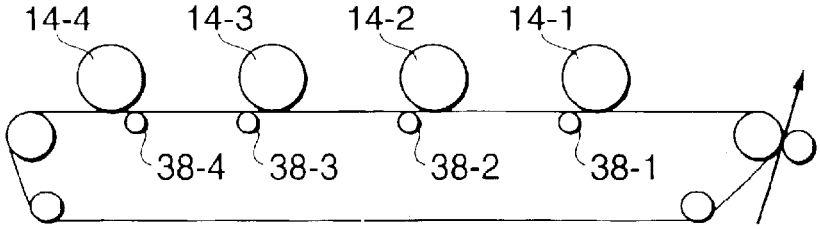

FIGS. 16A to 16F show various arrangements of the intermediate transfer rollers 38-1 through 38-4 in relation with the corresponding photosensitive drums 14-1 through 14-4 for primary transfer according to other embodiments of the present invention. FIG. 16A shows a case where the intermediate transfer rollers 38-1 and 38-2 are upstream from the corresponding nips while the rollers 38-3 and 38-4 are downstream from the corresponding nips. FIG. 16B shows a case that the intermediate transfer rollers 38-1, 38-2, and 38-3 are upstream while the roller 38-4 is downstream. FIG. 16C shows a case where all the intermediate transfer rollers 38-1 through 38-4 are upstream from the corresponding nips. FIG. 16D shows a case where only the intermediate transfer roller 38-1 is downstream and the other rollers, 38-2, 38-3, and 38-4 are upstream. FIG. 16E shows a case where the intermediate transfer rollers 38-1 and 38-2 are down stream while the rollers 38-3 and 38-4 are upstream. FIG. 16F shows a case where the intermediate transfer rollers 38-1, 38-2, and 38-3 are downstream and the roller 38-4 is upstream. In preferred embodiments of the present invention, the number of image forming units is 4 because four colors are handled. However, the number of image forming units may be varied as needed; if more than or less than four image forming units are used, the number of intermediate transfer rollers may be varied accordingly and various combinations of roller positions (either upstream or downstream from the transfer nips) are possible.

Figure 17:
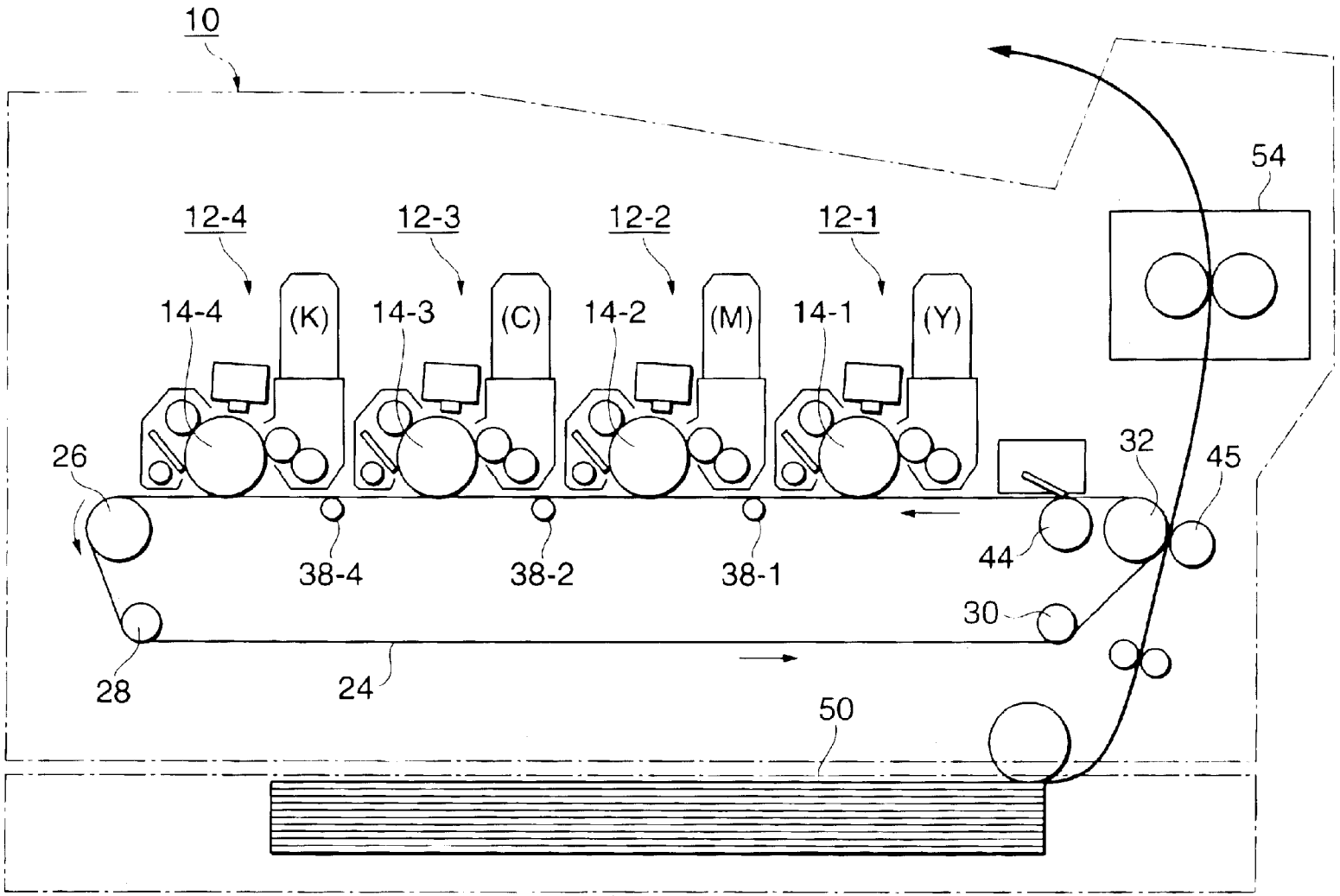
FIG. 17 illustrates an embodiment of the invention where the number of intermediate transfer rollers is 1 smaller than that of photosensitive drums.

FIG. 17 shows a color printer as an image forming apparatus according to another embodiment of the present invention. An outstanding feature of this embodiment is that the number m of intermediate transfer rollers for primary transfer is smaller than the number of image forming units, or the number n of photosensitive drums. As illustrated in FIG. 17, there are four photosensitive drums 14-1 through 14-4 in image forming units 12-1 through 12-4 (n=4) and there are three intermediate transfer rollers 38-1 through 38-3 for primary transfer with an intermediate transfer belt 24 between the drums and rollers (m=3). If the distance between two neighboring drums (14-1 through 14-4) is 90 mm, the intermediate transfer rollers 38-1 through 38-3 should be almost at the midpoint between two drums, or approximately 45 mm from both the nips. Here, as in the embodiment shown in FIG. 5, the drive roller 26 and the backup roller 32 are electrically floating and the tension rollers 28 and 30 and the grounding roller 44 are grounded. Also as in the embodiment shown in FIG. 5, the single power supply 40 supplies transfer voltage to the three intermediate transfer rollers 38-1 through 38-3.

Figure 18:
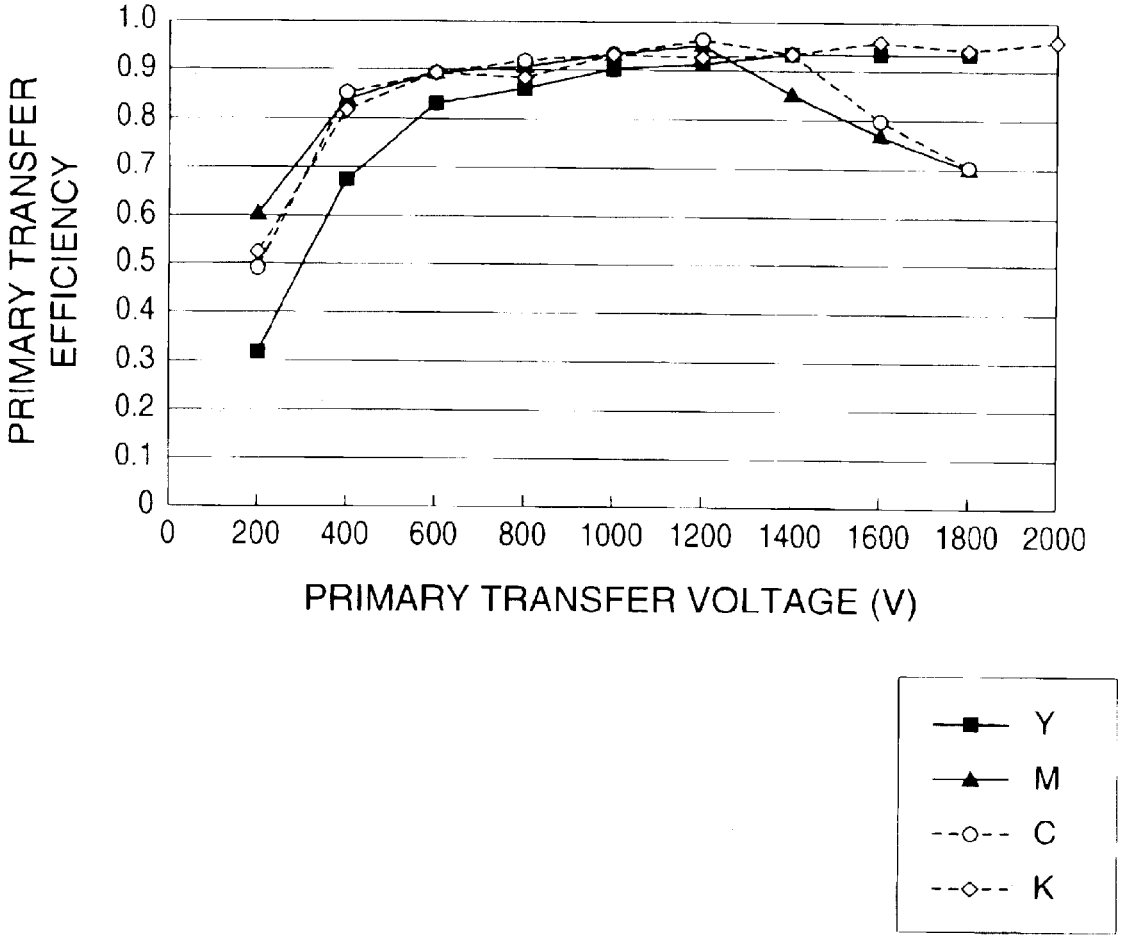
FIG. 18 is a characteristic graph showing primary transfer efficiency versus primary transfer voltage for four colors in the embodiment shown in FIG. 17.

FIG. 18 shows transfer efficiency versus primary transfer voltage as a result of measurement in the embodiment shown in FIG. 17 where the single power supply supplies primary transfer voltage to the intermediate transfer rollers 38-1 through 38-3. As apparent from this transfer efficiency versus voltage graph, assuming that a transfer efficiency of 90% or more is adequate, it may be said that in this case the voltage range of approximately 1000 V to 1300 V corresponds to a voltage margin to ensure that the transfer efficiency is 90% or more. Consequently, it has been confirmed that primary transfer can be made adequately even when the number of intermediate transfer rollers is 3 though the number of transfer nips of photosensitive drums 14-1 through 14-4 is 4, as in the embodiment shown in FIG. 17. When the number of intermediate transfer rollers is smaller than the number of photosensitive drums as in this case, the manufacturing cost of the primary transfer mechanism can be considerably reduced.

Figure 19:
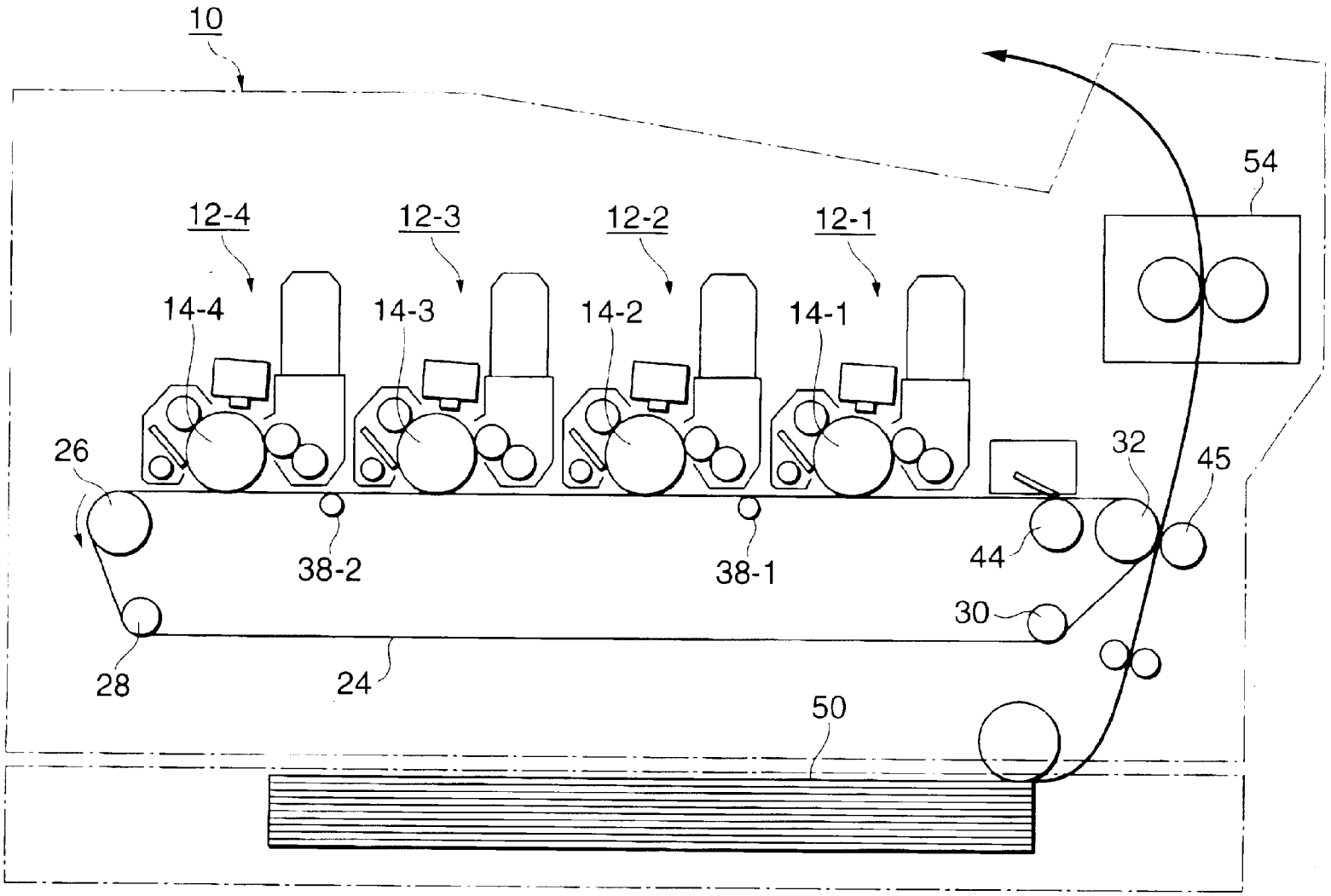
FIG. 19 illustrates an embodiment of the invention where the number of intermediate transfer rollers is 2 smaller than that of photosensitive drums.

FIG. 19 shows another embodiment where the number of intermediate transfer rollers for primary transfer is smaller than the number of photosensitive drums. This embodiment has four photosensitive drums 14-1 through 14-4 (n=4) and two intermediate transfer rollers 38-1 and 38-2 (m=2). The intermediate transfer rollers 38-1 and 38-2 are respectively located almost at the midpoint between the photosensitive drums 14-1 and 14-2, and between the drums 14-3 and 14-4, i.e. 45 mm from each nip on condition that the drum-to-drum distance is 90 mm.

Figure 20:
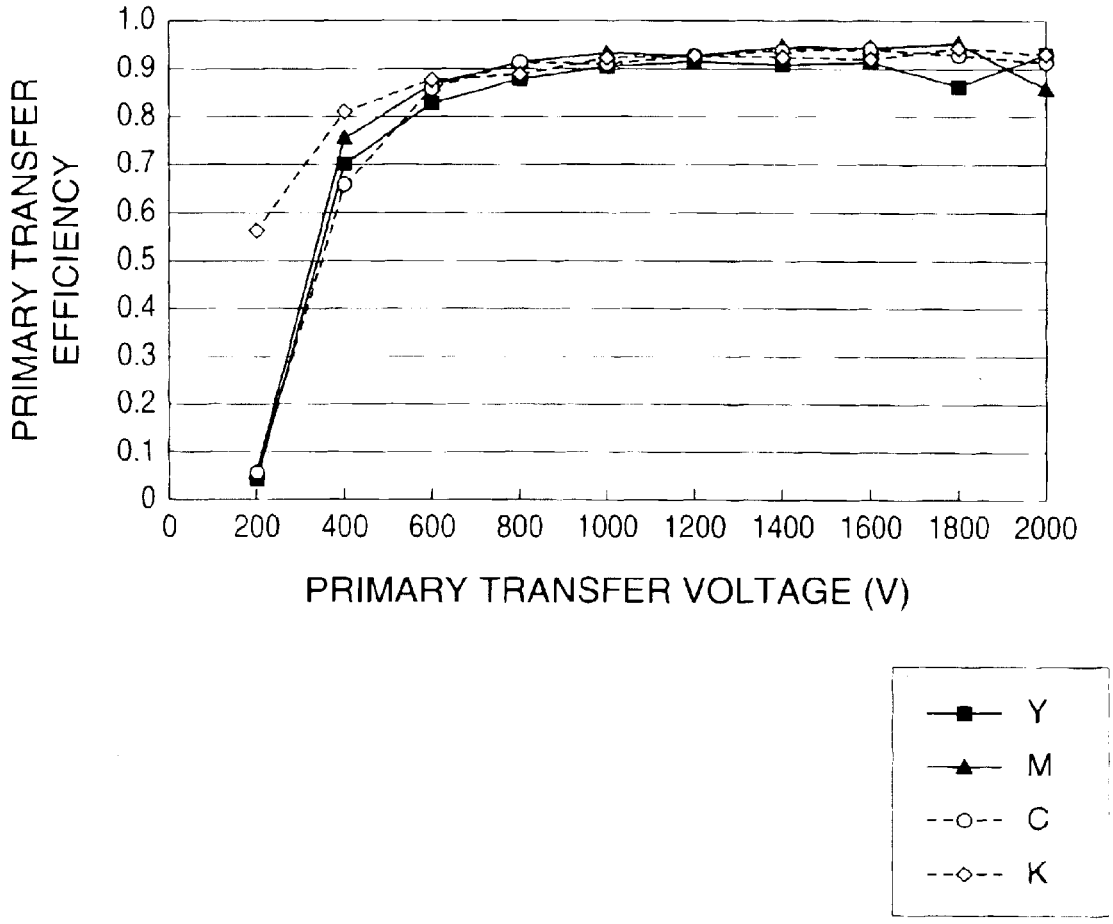
FIG. 20 is a characteristic graph showing primary transfer efficiency versus primary transfer voltage in the embodiment shown in FIG. 19.

FIG. 20 shows transfer efficiency versus primary transfer voltage as a result of measurement in the embodiment shown in FIG. 19 where primary transfer voltage is supplied to the intermediate transfer rollers 38-1 and 38-2. In this case, when the voltage is as high as approximately 950 V or more, an adequate transfer efficiency of 90% or more is attained. Therefore, it has been confirmed here that there is a voltage margin to ensure adequate transfer efficiency.

Figure 21A:
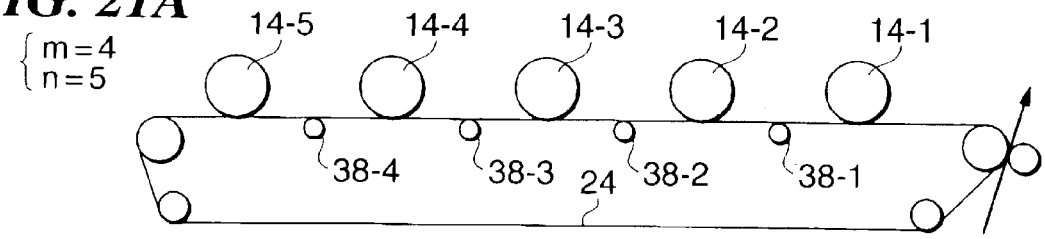
FIGS. 21A through 21E illustrate other embodiments where the number of intermediate transfer rollers is smaller than that of photosensitive drums.
Figure 21B:
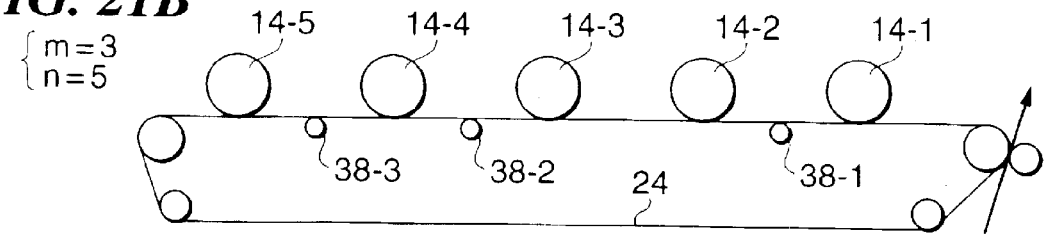
Figure 21C:
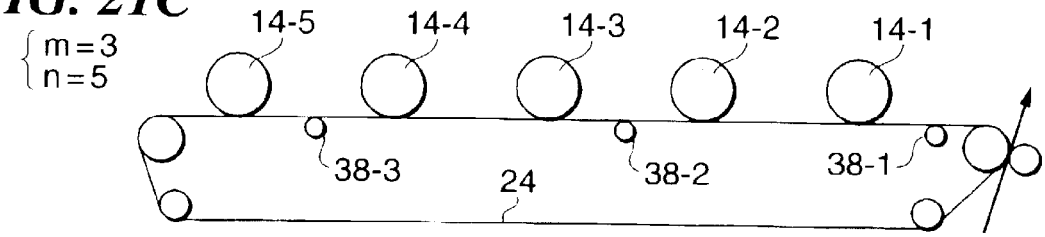
Figure 21D:
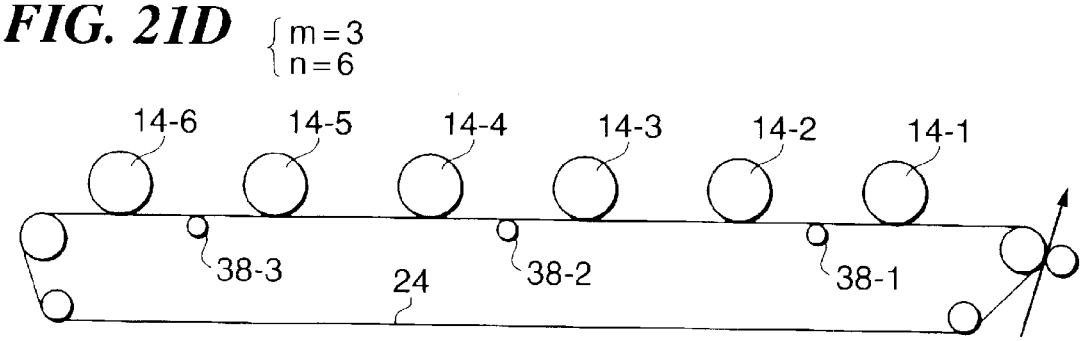
Figure 21E:
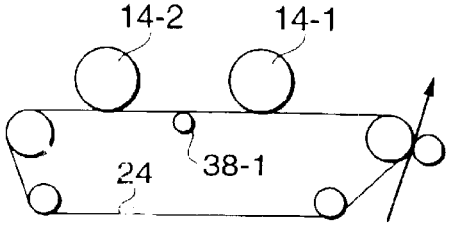

FIGS. 21A to 21E show various cases where the number m of intermediate transfer rollers for primary transfer is smaller than the number n of photosensitive drums. FIG. 21A shows a case where while the number n of photosensitive drums (14-1 through 14-5) is 5, the number m of intermediate transfer rollers (38-1 through 38-4) is 4. FIG. 21B shows a case where while the number n of photosensitive drums (14-1 through 14-5) is 5, the number m of intermediate transfer rollers (38-1 through 38-3) is 3. In this case, the intermediate transfer roller 38-1 is located at the midpoint between the two photosensitive drums 14-1 and 14-2 on the upstream side and the other intermediate transfer rollers 38-2 and 38-3 are located at the midpoint between the photosensitive drums 14-3 and 14-4 and between the drums 14-4 and 14-5, respectively. FIG. 21C shows a case where the number of intermediate transfer rollers (38-1 through 38-3: m=3) is 2 smaller than the number of photosensitive drums (14-1 through 14-5: n=5), like the case of FIG. 21B but the positions of the intermediate transfer rollers 38-1 through 38-3 are different from those in FIG. 21B. In this case, the intermediate transfer roller 38-1 is located upstream from the most upstream photosensitive drum 14-1. The intermediate transfer roller 38-2 in the middle is located at the midpoint between the photosensitive drums 14-2 and 14-3. The third intermediate transfer roller 38-2 is located at the midpoint between the photosensitive drums 14-4 and 14-5 like the case of FIG. 21B. FIG. 21D shows a case where the number m of intermediate transfer rollers (38-1 through 38-3) is 3 while the number n of photosensitive drums (14-1 through 14-6) is 6. FIG. 21E shows a case where there is only one intermediate transfer roller (38-1: m=1) while there are two photosensitive drums (14-1 and 14-2: n=2). On the condition that the number of photosensitive drums is 2 or more, the present invention covers any arrangement of a smaller number of intermediate transfer rollers in relation with the drums.

FIGS. 22A to 22G show various concrete examples of intermediate transfer electrode members which may be used in the primary transfer process according to the present invention. Since the intermediate transfer electrode members are located on the belt surface away from the transfer nips as the belt contact points of the photosensitive drums, the intermediate transfer electrode members may be made of metal. Concrete examples of such metal members are illustrated in FIGS. 22A to 22G.

Figure 22A:
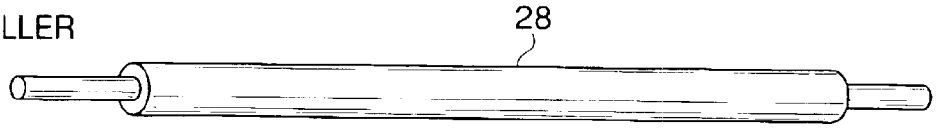
FIGS. 22A through 22G show concrete examples of metal intermediate transfer electrode members which may be used in the present invention.
Figure 22B:
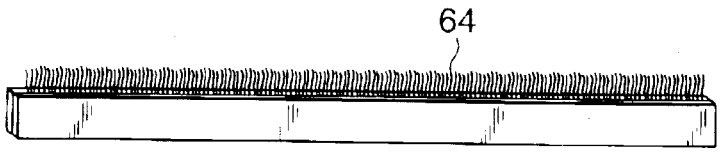
Figure 22C:
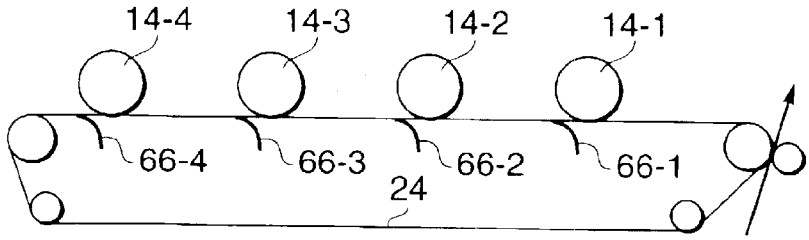
Figure 22D:
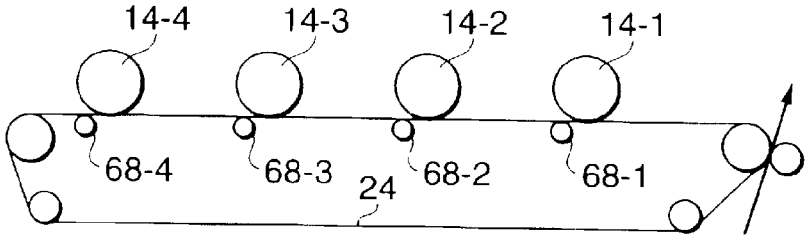
Figure 22E:
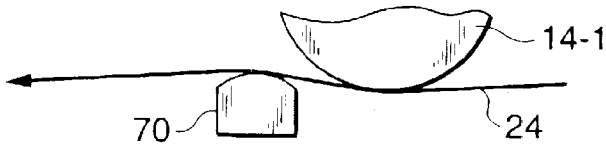
Figure 22F:
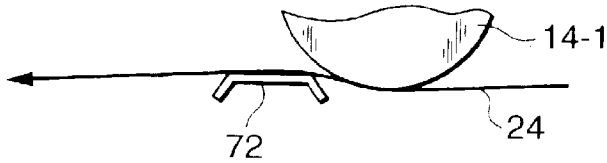
Figure 22G:
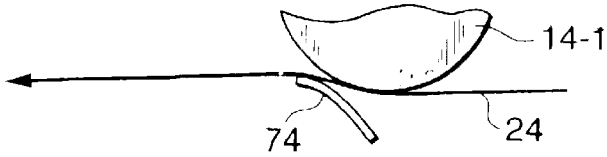

FIG. 22A shows a metal roller 28. FIG. 22B shows a metal brush 64. FIG. 22C shows metal sheets 66-1 through 66-4. FIG. 22D shows metal shafts 68-1 through 68-4: concretely they may be conventional sponge roller shafts. FIG. 22E shows a metal block 70. FIG. 22F shows a metal plate 72. FIG. 22G shows a metal blade 74. Any of the metal intermediate transfer members shown in FIGS. 22A to 22G should be positioned in a way that the intermediate transfer belt 24 contacts the photosensitive drum 14-1 with a prescribed winding angle as illustrated in FIG. 6 to ensure a transfer nip width of approximately 1 mm.

The above embodiments assume that the invention is applied to a color printer. However, the invention may be applied to a copier which uses paper as a recording medium or an apparatus which forms images on another type of recording medium. The invention may be appropriately embodied in other forms without sacrificing any of the objects and advantages thereof. Also the invention is not limited by the numerical data shown concerning the above embodiments.

In conclusion the invention is industrially applicable for the following reasons.

According to the present invention, the transfer rollers as intermediate transfer members are located on the belt surface away from the belt contact points (transfer nips) of the photosensitive drums as image holders, therefore low cost rollers like metal rollers may be used instead of conventional costly conductive sponge rollers. The use of metal intermediate transfer members reduces cost and improves durability, stability, and reliability.

Also, the intermediate transfer electrode members are located on the belt surface away from the transfer nips as the belt contact points of the photosensitive drums to employ the intermediate transfer belt's resistance in the surface direction, namely surface resistance to generate an electric field for transfer. The surface resistance of the intermediate transfer belt is relatively stable even when the belt deteriorates or the applied transfer voltage varies, thereby assuring stability in transfer over time.

According to the invention, the apparatus has a structure to isolate the primary transfer area and secondary transfer area of the intermediate transfer belt electrically, so even if primary transfer and secondary transfer take place simultaneously, an electrical influence can be prevented and stability in the primary and secondary transfer processes can be assured. In addition, since the drive roller supporting the intermediate transfer belt and the backup roller, located opposite to it, are electrically floating, loss of current upon application of transfer voltage can be prevented.

Furthermore, according to the invention, since the number of intermediate transfer rollers as intermediate transfer electrode members for primary transfer is smaller than the number of photosensitive drums as image holders, the manufacturing cost of the intermediate transfer mechanism in the single-pass printing system can be substantially reduced.

What is claimed is:

1. An image forming apparatus comprising:

plural image forming units which form visible images of different colors by making developers of different colors adhere to image holders electrostatically;

a belt transfer member which lies in contact with image holders for the different colors to transfer the developers adhering to the image holders of the image forming units thereto and make the transferred images overlap each other; and intermediate transfer electrode members, located opposite to the image holders of the image forming units with the belt transfer member between the electrode members and the image holders, to which transfer voltage is applied to transfer images electrostatically from the image forming units to the belt transfer member in sequence and make the transferred images overlap each other, wherein each of the plural intermediate transfer electrode members is located on a belt surface away from a point at which a corresponding image holder contacts the belt.

2. The image forming apparatus according to claim 1, wherein the plural intermediate transfer electrode members are located on the belt transfer member downstream from the points at which the image holders contact the belt.

3. The image forming apparatus according to claim 1, wherein the most upstream intermediate transfer electrode member is located upstream from the point at which the most upstream image holder contacts the belt, and the most downstream intermediate transfer electrode member is located downstream from the point at which the most downstream image holder contacts the belt.

4. The image forming apparatus according to claim 1, further comprising:

a medium transfer electrode member which applies transfer voltage to the belt transfer member in order to transfer overlapping, transferred visible images to a recording medium such as paper at a time;

a backup roller which is located opposite to the medium transfer electrode member with the belt transfer member between them;

a tension roller which is located between a drive roller and the backup roller to apply tension to the belt transfer member; and an electrical isolation structure which electrically isolates the intermediate transfer electrode members and the image holders, which are in contact with the belt transfer member, from the medium transfer electrode member.

5. The image forming apparatus according to claim 4, wherein in the electrical isolation structure, the drive roller and the backup roller are electrically floating, the tension roller is electrically grounded, and there is an electrically grounded grounding roller opposite to a cleaning member located between the backup roller and an adjacent image holder with the belt transfer member between the cleaning member and the grounding roller.

6. The image forming apparatus according to claim 4, wherein the tension roller is almost at the midpoint between the drive roller and the backup roller.

7. The image forming apparatus according to claim 1, wherein the following relation exists between a number m of the image holders and a number n of the intermediate transfer electrode members: $n<m$, and $n \geqq 1$.

8. The image forming apparatus according to claim 1, wherein a surface resistance of the belt transfer member is in a range from $5\times10^{8}$ Ω/□ to $5\times10^{10}$ Ω/□.

9. The image forming apparatus according to claim 1, wherein the intermediate transfer electrode member is made of metal.

10. The image forming apparatus according to claim 1, wherein the intermediate transfer electrode member is a metal roller, a metal brush, a metal sheet, a metal shaft, a metal block, a metal plate or a metal blade.

11. An imaging method comprising:

an image forming step of forming visible images of different colors by making developers of different colors adhere to image holders electrostatically; and an intermediate transfer step of sequentially transferring the different color images adhering to the plural image holders onto a belt transfer member electrostatically and making the transferred images overlap each other, wherein, at the intermediate transfer step, transfer voltage is applied on a belt surface at places away from points at which the image holders contact the belt.

* * * * *